US009759098B1

(12) United States Patent
Chapman, Jr.

(10) Patent No.: US 9,759,098 B1
(45) Date of Patent: Sep. 12, 2017

(54) VALVETRAIN CONVERSION KIT FOR AN ENGINE

(71) Applicant: William Cullen Chapman, Jr., Torrance, CA (US)

(72) Inventor: William Cullen Chapman, Jr., Torrance, CA (US)

( * ) Notice: Subject to any disclaimer, the term of this patent is extended or adjusted under 35 U.S.C. 154(b) by 0 days.

(21) Appl. No.: 15/261,667

(22) Filed: Sep. 9, 2016

(51) Int. Cl.

| | |
|---|---|
| ***F01L 1/02*** | (2006.01) |
| ***F01L 1/053*** | (2006.01) |
| ***F01M 9/10*** | (2006.01) |
| ***F02B 67/04*** | (2006.01) |

(52) U.S. Cl.
CPC ..... *F01L 1/026* (2013.01); *F01L 1/053* (2013.01); *F01M 9/105* (2013.01); *F01M 9/106* (2013.01); *F02B 67/04* (2013.01); *F01L 2250/06* (2013.01)

(58) Field of Classification Search
CPC ..... F01L 1/026; F01L 1/053; F01L 2250/06; F01M 9/105; F01M 9/106; F02B 67/04
See application file for complete search history.

(56) References Cited

U.S. PATENT DOCUMENTS

| | | | |
|---|---|---|---|
| 3,952,604 | A | 4/1976 | Baudler |
| 5,000,612 | A | 3/1991 | Swars |
| 5,054,334 | A | 10/1991 | Swars |
| 5,419,217 | A | 5/1995 | Umezawa et al. |
| 7,296,495 | B2 | 11/2007 | Quinn |
| 7,810,412 | B2 | 10/2010 | Yamasaki et al. |
| 8,555,838 | B2 | 10/2013 | Petry-Johnson et al. |
| 8,801,368 | B2 | 8/2014 | Noller et al. |
| 2004/0200315 | A1 | 10/2004 | Bourne et al. |
| 2007/0151379 | A1 | 7/2007 | Lukanen, Jr. |
| 2011/0120794 | A1 | 5/2011 | Hobel |
| 2013/0298711 | A1* | 11/2013 | Camps ..... B23P 15/14 74/434 |
| 2015/0226302 | A1 | 8/2015 | Handa et al. |
| 2016/0033026 | A1 | 2/2016 | Tsukahara et al. |

FOREIGN PATENT DOCUMENTS

| | | |
|---|---|---|
| CN | 202484245 | 10/2012 |
| JP | H05306744 | 11/1993 |

OTHER PUBLICATIONS

Motor City Garage, *Cammer—The Real Story of the Legendary Ford 427 SOCH V8*, Aug. 21, 2014, available at http://www.macsmotorcitygarage.com/2014/08/21/cammer-the-real-story-of-the-legendary-ford-427-sohc-v8/.

* cited by examiner

*Primary Examiner* — Zelalem Eshete
(74) *Attorney, Agent, or Firm* — Knobbe, Martens, Olson & Bear, LLP

(57) ABSTRACT

A valvetrain conversion kit for an engine can comprises at least one timing idler rim gear configured to be meshed with at least one of a crank gear of the engine and a cam gear of the engine. The kit can include a first timing gear chamber member having a plurality of engine mounting locations corresponding to a plurality of corresponding cover mounting locations on an internal combustion engine body. The first timing gear chamber member can be configured to be rigidly attached to an engine body at the plurality of engine mounting locations. The first timing gear chamber member can also include a timing idler rim gear shaft supported by the interior surface, the timing idler rim gear shaft having an exterior shaft surface where the exterior shaft surface is configured for rotatably supporting the timing idler rim gear.

22 Claims, 23 Drawing Sheets

VALVETRAIN CONVERSION KIT FOR AN ENGINE

FIELD OF THE INVENTION

The present inventions disclosed herein relate to drivetrains formed of meshed gears such as those valvetrain systems used for driving camshafts in overhead valve engines.

BACKGROUND

The valvetrain system of an engine performs an important function in the operation of an engine and can affect performance of the engine. In many current commercial engines, the valvetrain system includes one or more camshafts driving one or more intake valves and one or more exhaust valves for each cylinder. Generally, in a four-stroke engine having an intake stroke, a compression stroke, a power stroke and an exhaust stroke, the intake valves open during the intake stroke and close during the compression stroke and the exhaust valves open during the exhaust stroke and close during the intake stroke. The intake valves control the ingress of combustion reactants, such as air and/or fuel, into the combustion chamber and exhaust valves control the egress of combustion products, such as $H_2O$, CO, $CO_2$, $NO_x$, and unburned hydrocarbons out of the combustion chamber.

The timing and movement of the intake valve and exhaust valve can play a significant role in the overall performance of an engine, such as the volumetric efficiency and maximum engine speed. Accordingly, precise synchronization of the piston and crankshaft movements with the valve and camshaft movements is of paramount importance to an engine. The camshafts are generally configured to control the timing and movement of the valves and are generally timed in accordance with movement of the pistons by means of a crankshaft coupled with the camshafts through a drivetrain. Existing drivetrains include serpentine belts, chains, and geartrains which transmit rotational energy from the crankshaft of the engine to the camshafts.

SUMMARY OF THE INVENTIONS

An aspect of at least one of the embodiments disclosed herein includes the realization that a rim gear (a gear having the hub and/or webbing removed) can be used as an idler gear of a geartrain in a valvetrain of an engine. Using a rim gear can provide the benefit of reducing weight and inertia in the geartrain and thereby increase engine efficiency. For example, lowering the inertia of a geartrain can reduce the power required to accelerate an engine improving fuel efficiency. Additionally, lower inertia can allow the engine to increase crankshaft speed (RPM) more quickly. Faster engine speed acceleration can be beneficial, for example, in racing and other applications. Thus, in some embodiments, the geartrain can include a rim gear meshed with other gears in the geartrain as an idler gear. In some embodiments, a geartrain for an internal combustion engine can include a rim gear and an idler gear shaft configured to rotatably support the rim gear.

Another aspect of at least one of the embodiments disclosed herein includes the realization that existing engine blocks, including cam-in-block engines, can be converted to an overhead cam engine using a conversion kit to for converting a push-rod engine to an overhead cam engine. In some embodiments, the kit can include at least one chamber member, at least one timing idler gear, and at least one corresponding idler gear shaft extending from the chamber member. The kit can be configured such that the chamber member mounts to the engine and provides a replacement drivetrain between at least one cam shaft and a crank shaft of the engine. The use of such a conversion kit can provide the advantage of a convenient means of converting an existing engine into an overhead cam engine using a geartrain without the need to physically embed gear shafts into the engine block or head and without the added maintenance of a belt or chain tensioner. Moreover, in some embodiments, the chamber member can be configured to provide convenient access to the geartrain for maintenance.

Another aspect of at least one of the embodiments disclosed herein includes the realization of the advantages of replacing an existing drivetrain such as a serpentine belt or timing chain with a timing geartrain. A timing geartrain can withstand much greater forces and stresses and still operate with minimal required maintenance and with a low risk of failure as compared to a belt or chain.

Another aspect of at least one of the embodiments disclosed herein includes the realization that a timing idler gear can comprise a power takeoff shaft (PTO). In some embodiments, the power takeoff shaft can be rigidly fixed to an idler gear and/or a rim gear and provide a location to power various engine components including an alternator, water pump, supercharger, air conditioner, oil pump, or power steering, etc. In some embodiments, the rim gear provides the advantage of reducing the overall weight and inertia of the power takeoff gear, but also can evenly distribute the stress from the power takeoff shaft through the rim shape. In some embodiments, the timing idler gear comprising at least one PTO can reduce the overall footprint of the engine.

Another aspect of at least one of the embodiments disclosed herein includes the realization that the chamber member can provide a plurality of locations for mounting various engine components. Often, engine components are mounted around the sides and top of an engine because there is insufficient space to mount them near the crankshaft. Often these components are powered by lengthy belts and chains that require manual or automatic tensioning and regular maintenance and replacement. As such, in some embodiments, the chamber member can provide space for engine components to be mounted directly to the chamber member, optionally, near the crankshaft, and/or use at least one power takeoff coupled with the timing idler gear. The timing geartrain also offers more precise synchronization of the valvetrain than a timing chain or serpentine belt because it does not have slack from any lack of tension as found in the belt or chain.

In some embodiments disclosed herein, a valvetrain conversion kit for an engine comprises at least one timing idler rim gear configured to be meshed with at least one of a crank gear of the engine and a cam gear of the engine. The kit further comprises a first timing gear chamber member having an interior surface and an exterior surface. The first timing gear chamber member can have a plurality of engine mounting locations corresponding to a plurality of corresponding cover mounting locations on an internal combustion engine body. The first timing gear chamber member can be configured to be rigidly attached to an engine body at the plurality of mounting locations. The first timing gear chamber member can further comprise a timing idler rim gear shaft supported by the interior surface, the timing idler rim gear shaft having an exterior shaft surface where the exterior shaft surface is configured to rotatably support the timing idler rim gear. Optionally, an oil passageway extends at least partially through a boss on the timing idler rim gear shaft to the exterior shaft surface and is configured to guide a lubricant to a lubricant space between the exterior shaft surface and a rotational surface of the timing idler rim gear when the at least one timing idler rim gear is positioned about the exterior shaft surface.

In some embodiments disclosed herein, the valvetrain conversion kit comprises a second timing gear chamber member configured to engage the first timing gear chamber member to define an enclosed timing gear chamber about the at least one timing idler gear and the timing idler rim gear shaft. Optionally, the first timing gear chamber member faces towards the engine when assembled with the internal combustion engine or the first timing gear chamber member faces away from the engine when assembled with the internal combustion engine.

In some embodiments disclosed herein, an internal combustion engine comprises an engine block, the engine block including an engine body supporting a crank shaft, an overhead valve camshaft, and a timing geartrain disposed on a first side of the engine body and configured to transmit torque from the crankshaft to the overhead valve camshaft. The timing geartrain can include a crank gear coupled with the crankshaft, a cam gear coupled with the overhead valve camshaft, and an idler rim gear meshed with at least one of the crank gear and the cam gear. An idler rim gear shaft can be disposed on the first side of the engine body and rotatably support the idler rim gear.

All of these embodiments are intended to be within the scope of at least one of the inventions disclosed herein. These and other embodiments of the inventions will become readily apparent to those skilled in the art from the following detailed description of the preferred embodiments having reference to the attached Figures, the inventions not being limited to any particular preferred embodiment disclosed.

DETAILED DESCRIPTION

Figure 1:
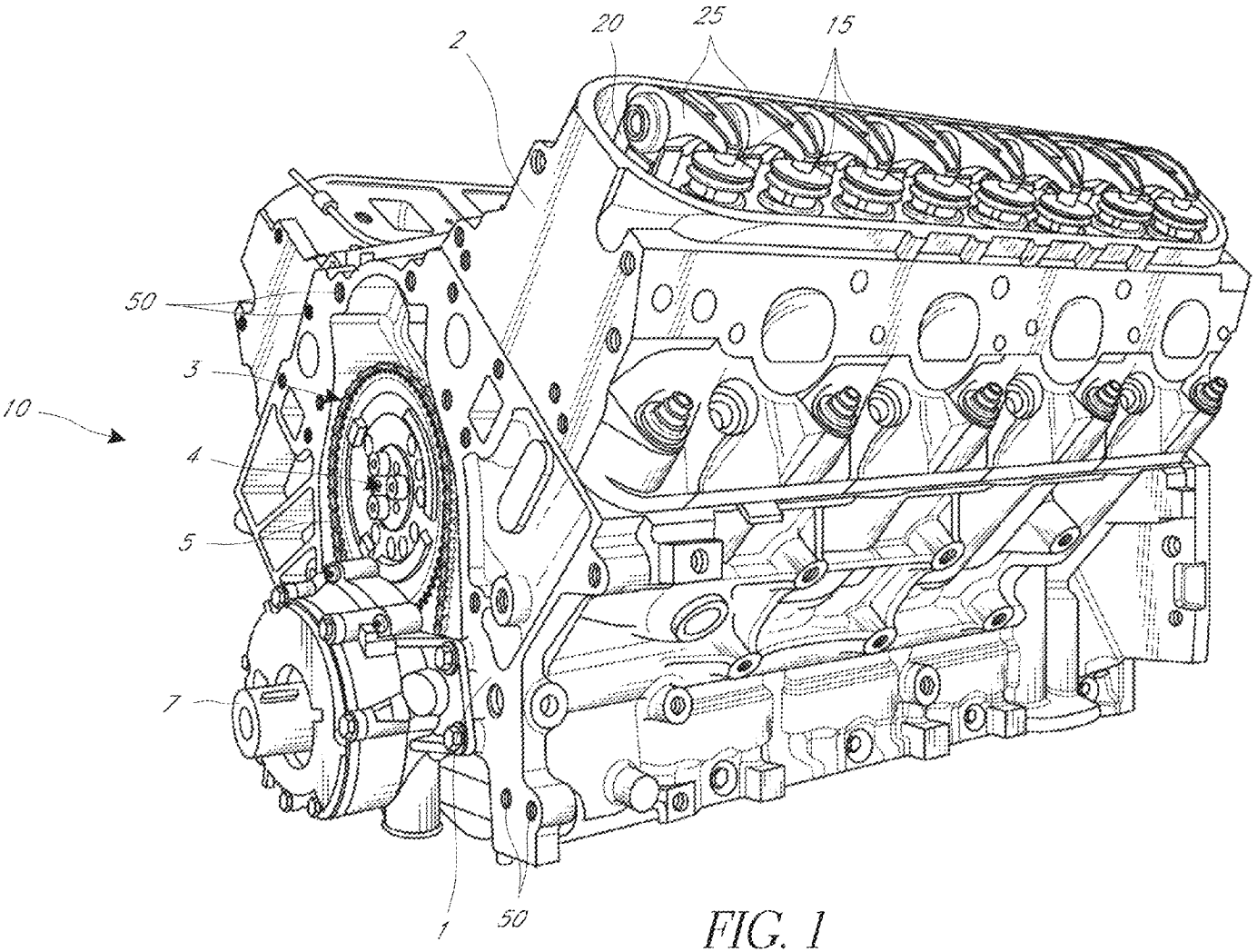
FIG. 1 (Prior Art)
FIG. 1 is perspective view of a conventional push-rod type engine comprising a valvetrain.

The following detailed description is merely illustrative in nature and is not intended to limit the embodiments of the subject matter or the application and uses of such embodiments. Any implementation described herein as exemplary is not necessarily to be construed as preferred or advantageous over other implementations. Furthermore, there is no intention to be bound by any expressed or implied theory presented in the proceeding technical field, background, brief summary, or the following detailed description.

Certain terminology can be used in the following description for the purpose of reference only, and thus are not intended to be limiting. For example, terms such as "upper", "lower", "above", and "below" refer to directions in the drawings to which reference is made. Terms such as "front", "back", "rear", "left side," and "right side" describe the orientation and/or location of portions of the component within a consistent but arbitrary frame of reference which is made clear by reference to the text and the associated drawings describing the component under discussion. Such terminology can include the words specifically mentioned above, derivatives thereof, and words of similar import. Similarly, the terms "first", "second", and other such numerical terms referring to structures do not imply a sequence or order unless clearly indicated by the context.

Conventional Valvetrains

With reference to FIGS. 1-4, a conventional valvetrain performs the function of transmitting torque from a crankshaft to a camshaft and providing proper timing between the crankshaft and the valve system in an internal combustion engine. However, prior art valvetrains have numerous disadvantages that are addressed by embodiments of the present inventions. While certain disadvantages of the prior art devices of FIGS. 1-4 are described below, such description is illustrative of some of the known disadvantages, but is not exhaustive.

FIG. 1 illustrates a prior art Chevrolet LS engine 10. The engine 10 includes a block 1 and cylinder heads 2 for each bank of cylinders. For purposes of clarity, other components of the engine 10, such as the intake manifold and the exhaust manifold, have been omitted. The valvetrain of the engine 10 includes a single camshaft (not shown) positioned within the block 1 at a location below the deck of the cylinder heads 2. The valvetrain also includes multiple overhead valves 15 positioned within the cylinder head 2 with a single intake valve and a single exhaust valve per cylinder of the engine 10. In order to actuate the valves 15 via the camshaft, the valvetrain includes a series of lifters (not shown), pushrods 20, and rocker arms 25 operably coupling the camshaft to the valves 15. This series of valvetrain components run from the block 1 to the cylinder heads 2 and thus present a significant amount of mass of the valvetrain system.

As shown along a front side of the engine 10, the single camshaft is driven by the crankshaft via a chain 3 coupled to a crank gear (not shown) attached to the crankshaft and a cam gear 5 attached to the camshaft, which is positioned within the block 1. The front side of the engine also includes a plurality of fastener holes 50 designed to receive and engage fasteners for attachment of various components, such as a cover (not shown), over the chain 3 and gear 5, as well as accessories such as an alternator (not shown), power steering pump (not shown), air conditioner compressor (not shown) and the like. Generally, the fastener holes 50 are designed to engage threads of a screw, bolt, stud or the like.

Figure 2:
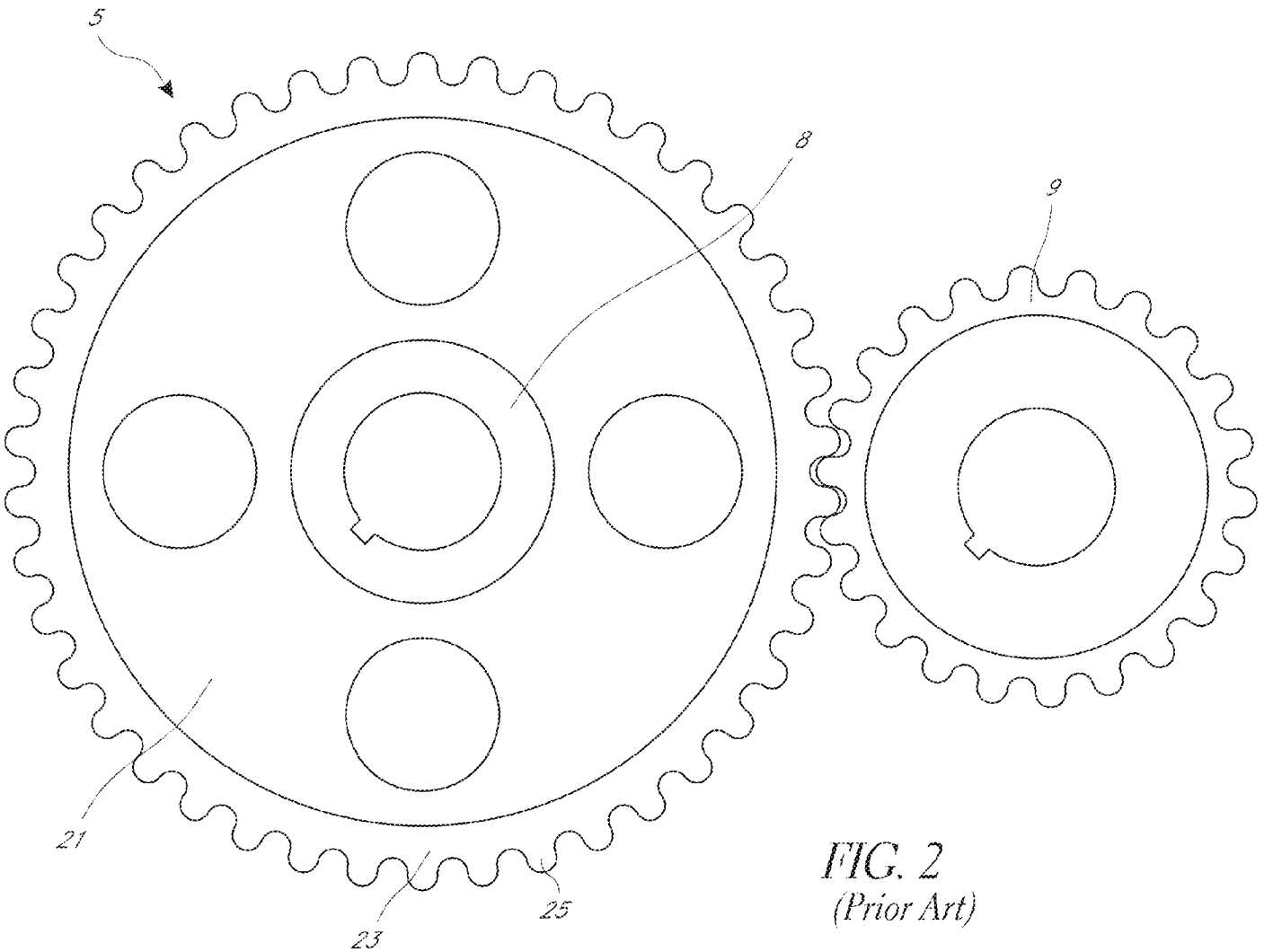
FIG. 2 (Prior Art)
FIG. 2 is a top view of a pair of conventional timing gears.

FIG. 2 is a top view of a conventional timing gear set such as those shown in FIG. 1. The timing gear set includes a crank gear 9 configured to be mounted on a crankshaft and a conventional timing gear 5. The timing gear 5 comprises a hub 8 configured to be mounted on a shaft, a rim 23 on which a plurality of gear teeth 25 are mounted, and a webbing 21 configured to connect the hub 8 to the rim 23. One of the disadvantages of timing gear 5 is the additional weight and inertia from the hub 8 and webbing 21.

In some embodiments of the present disclosure described below, one object is to provide a timing idler gear comprising a "rim gear"; a gear without a hub 8 connected to the gear teeth with webbing 21. Optionally, a rim gear is provided without some or all of the webbing to reduce weight and inertia. While the benefit of increased engine efficiency can be marginal for each individual gear, the reduced weight and inertia across an entire valvetrain comprising a plurality of gears can be a significant factor in increased efficiency.

Figure 3:
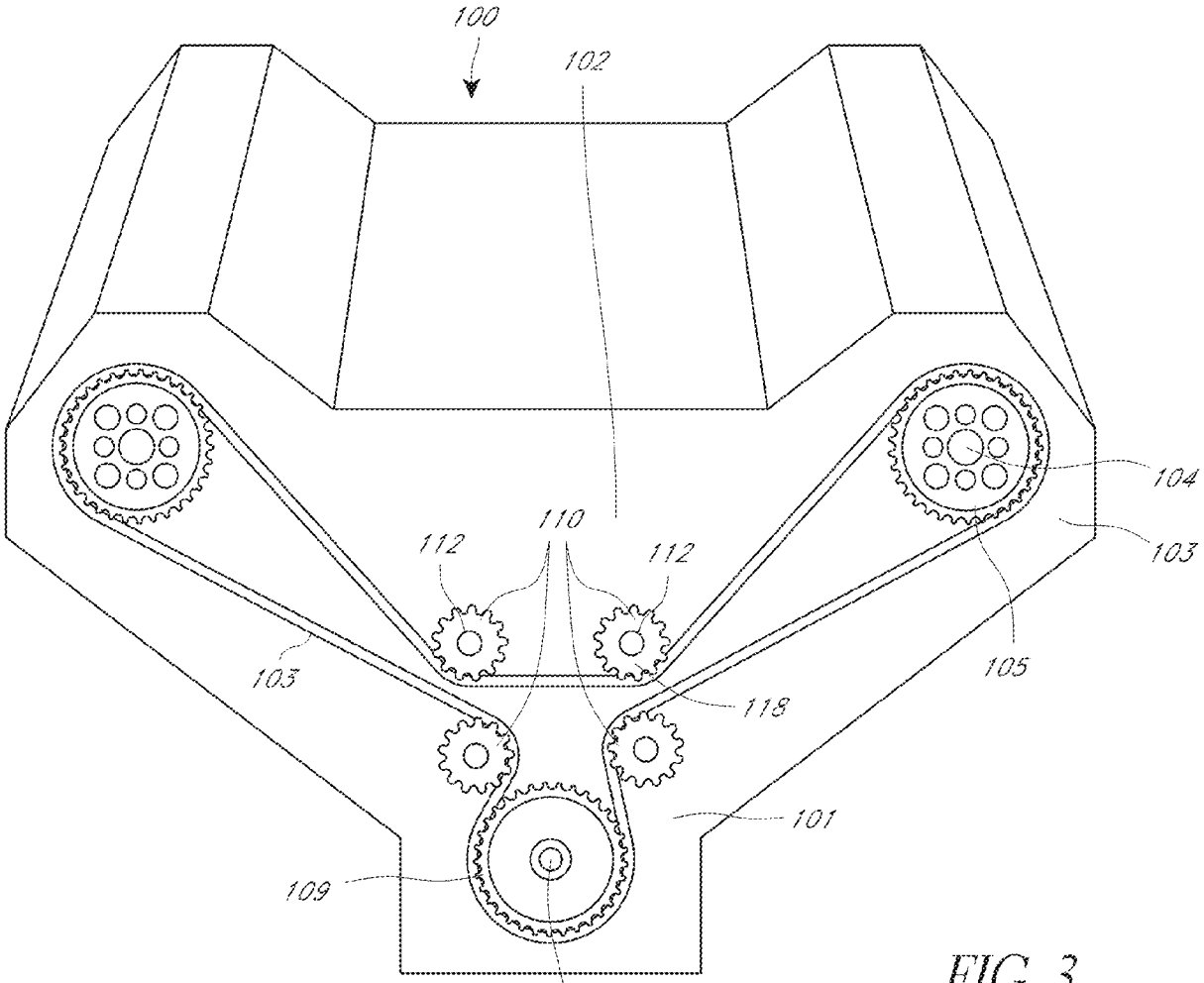
FIG. 3 (Prior Art)
FIG. 3 is a schematic illustration of a conventional overhead valve type engine using a serpentine timing chain as a valvetrain.

FIG. 3 is an illustration of a conventional overhead cam type engine using a serpentine timing chain or belt 103 to transfer torque from the crankshaft 107 to the camshaft 104. The engine includes an engine body 100 comprising a head 103, an engine block 101, and an engine housing wall 102. Affixed to engine housing 102 are a plurality of idler gear shafts 112. Idler gears 110 are rotatably mounted to the idler gear shafts 112.

Additional elements not shown include a tensioning mechanism to ensure that the lengthy timing chain 103 maintains sufficient tension to remain on the geartrain. Serpentine chains and belts take up a substantial amount of space particularly on the face of an engine. There can be insufficient space on the face of the engine for mounting other engine-powered accessories to the engine. These accessories can be displaced to the sides of the engine and/or to locations off of the engine in a less than optimal use of space.

Figure 4:
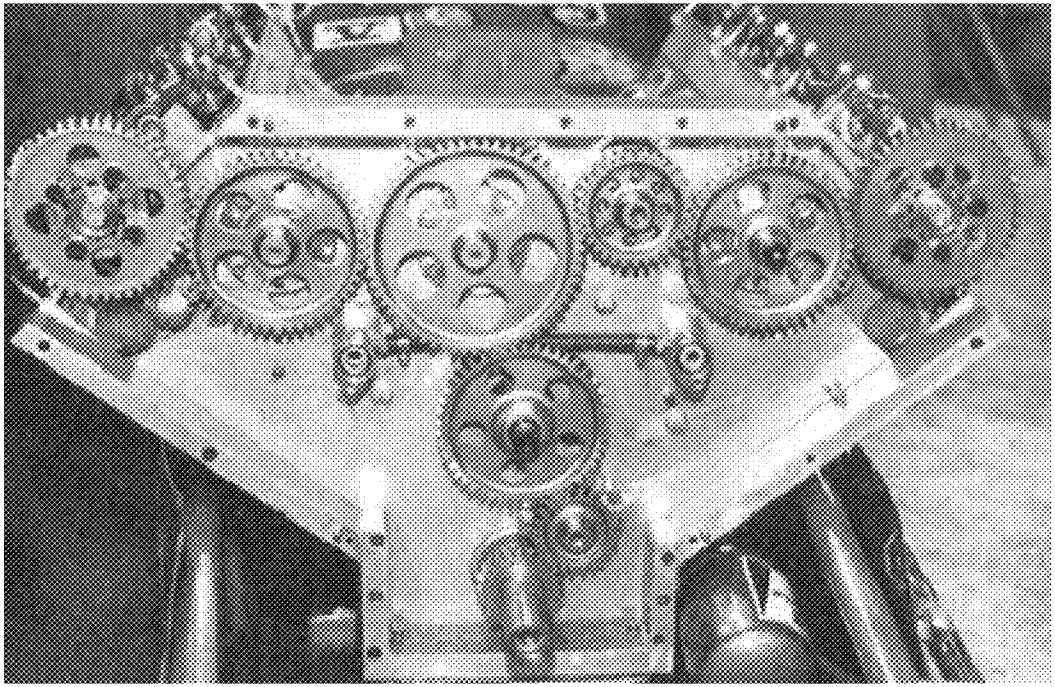
FIG. 4 (Prior Art)
FIG. 4 is a photograph of an overhead valve type engine using conventional idler gears in a valvetrain.

FIG. 4 is a photograph of a prior art timing system for driving overhead cams from the crankshaft of an engine. The engine shown in FIG. 4 is a Ford 427 SOHC V8, known as the "Cammer," and modified to use a timing geartrain with a plurality of meshed gears for driving overhead camshafts. As shown in FIG. 4, each of the idler gears in the timing geartrain includes both a hub and a webbing.

Figure 5:
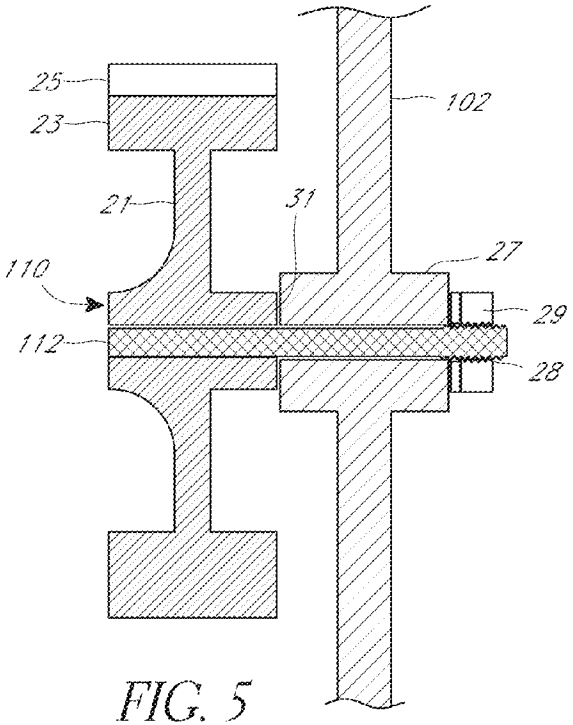
FIG. 5 is a cross-sectional view showing a conventional idler gear with a reinforced section of the engine housing wall.

FIG. 5 is a section view showing an idler gear 110 with a reinforced section 27 required to mount an idler gear shaft to engine housing wall 102. Idler gear 110 is fixedly attached to idler shaft 112. The idler shaft 112 is rotatably mounted to engine housing wall 102. However, in order to support the weight and force placed on the idler shaft 112, the engine housing wall is reinforced such as in the manner shown in FIG. 5. Reinforced section 27 enables the engine housing wall 12 to support this additional force. One aspect of some embodiments of the present disclosure includes the realization that a idler shaft need not be directly mounted to the engine housing wall and instead can be mounted to a chamber member.

Conversion Kit for Replacing an Existing Valvetrain

Figure 6A:
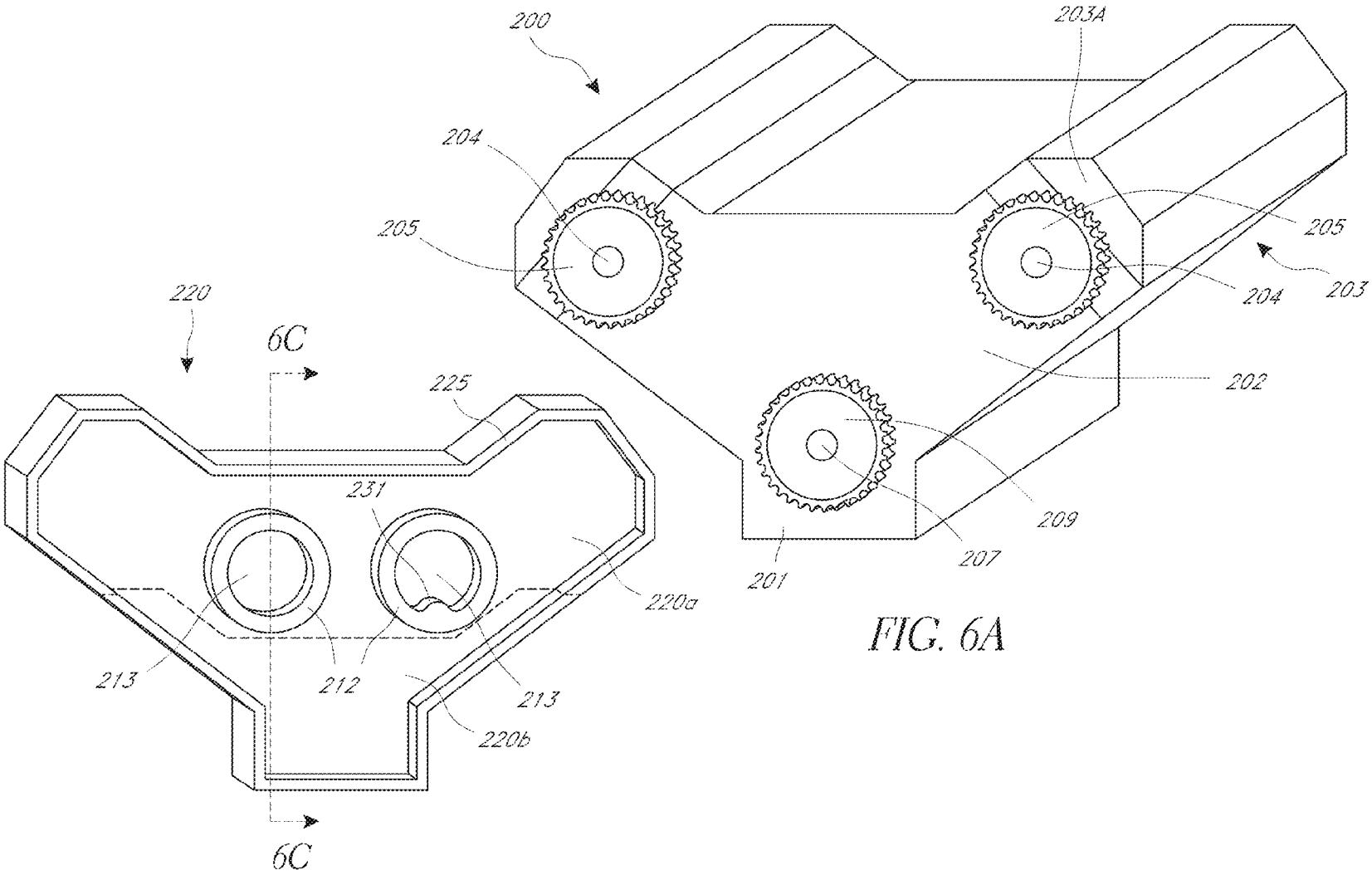
FIG. 6A is a schematic, exploded illustration of parts of an embodiment of a kit for replacing a conventional drivetrain of an engine including a chamber member and two idler gear shafts configured to support two timing idler gears.

FIG. 6A illustrates an embodiment of a conversion kit providing a replacement valvetrain for synchronizing the rotational movement of an overhead cam camshaft 204 with the crankshaft 207 using a timing idler gear shaft 212 coupled to a chamber member 220. As illustrated in FIG. 6A, an engine 200 comprises an engine block 201, at least one cylinder head 203, and an engine housing wall 202. The engine 200 can be designed as a cam-in-block engine that is converted into an overhead cam engine using the conversion kit. In some embodiments, engine 200 has been retrofitted with an overhead cam head 203 and valve cover 203A.

An overhead camshaft 204 is supported by the head 203 and extends outwardly therefrom. A cam gear 205 is mounted to the end of the camshaft 204. The camshaft 204 can be rotatably seated in the head 203 and configured to control the engine valve timing system in accordance with principles of operation of overhead cam valve systems which are well-known in the art. In some embodiments, the camshaft 204 extends through engine housing wall 202 to an exterior side of the engine 200.

The engine 200 additionally comprises a crankshaft 207 coupled with a crank gear 209. In some embodiments the crank gear 209 is fixedly coupled to the crankshaft 207. Optionally, the crank gear and the crankshaft extend from the housing wall 202 of engine 200. Crankshaft 207 operates to convert the linear motion of pistons within the engine into rotational energy as is well known in the art.

In some embodiments of the conversion kit, the chamber member 220 can comprise a bracket for spacing the chamber member 220 a predetermined distance from the engine housing 202. Optionally, the bracket comprises a peripheral wall 225. Optionally, peripheral wall 225 extends all around the perimeter of the chamber member 220. Optionally, the peripheral walls 225 extends away from an interior surface 223 of the chamber member 220. Optionally, the peripheral wall 225 is configured to conform to the contours of the engine housing walls 202. Optionally, when in the fully assembled state, the chamber member 220 is mounted to engine 200 to create a chamber 235 that encompasses the timing idler gear. Optionally, the profile of the chamber member 220 is configured to match or substantially match the profile of the engine housing wall 202. Optionally, the chamber member 220 is configured to overlay the timing geartrain and or to create a chamber encapsulating the timing idler gear between the engine housing wall 202 and the chamber member 220.

In some embodiments, the chamber member 220 comprises a top portion 220*a* and a bottom portion 220*b*. Optionally, the bottom portion 220*b* is configured to comprise an oil reservoir 280 as discussed below in reference to FIG. 7A. Optionally, both portions 220*a, b* are configured to be assembled with the engine 200. Optionally, the bottom portion 220*b* is configured to remain assembled with the engine 200 when the top portion 220*a* is removed from the engine 200 and thereby the oil reservoir 280 can remain in place while an operator obtains access to the geartrain by removing the top portion 220*a*.

In some embodiments of the conversion kit, the chamber member 220 can comprise an interior surface 223. Optionally, the interior surface 223 is substantially flat or in other embodiments it is curved or comprises contours. Optionally, the timing idler gear shaft 212 can extend from the interior surface 223. In some instances, this specification refers to a single timing idler gear, but such descriptions are intended to apply to embodiments including other numbers of idler gears, such as embodiments including multiple timing idler gears meshed with one of the crank gear 209, the cam gear 205 or another of the timing idler gears.

In some embodiments, the timing idler gear shaft 212 is formed integrally with the interior surface 223 to form a monolithic construction of the chamber member 220. Optionally, the monolithic construction can be cast, wrought, forged, hogged-out or machined. Optionally, the monolithic construction can be case of an aluminum alloy. Optionally, the idler gear shaft 212 can be mechanically fastened to interior surface 223 by at least one mechanical fastener including but not limited to screws and bolts. In other embodiments, timing idler shaft 212 can be welded or otherwise affixed to interior surface 223. In some embodiments the idler gear shaft 212 can comprise an interior space 213. In other embodiments idler gear shaft 212 can comprise a solid material where the interior space 213 would otherwise be. In some embodiments of the conversion kit the idler shaft 212 further comprises a boss 231, as described further in reference to FIG. 8C.

Figure 6B:
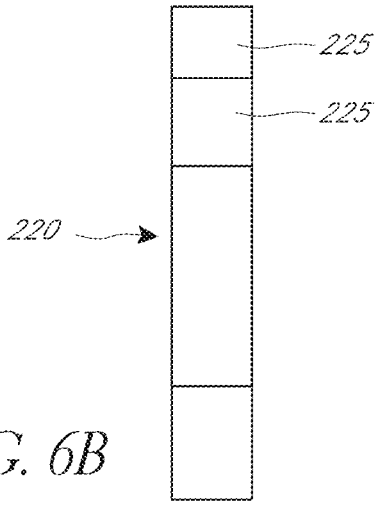
FIG. 6B is a side view of the chamber member of the kit of FIG. 6A.
Figure 6C:
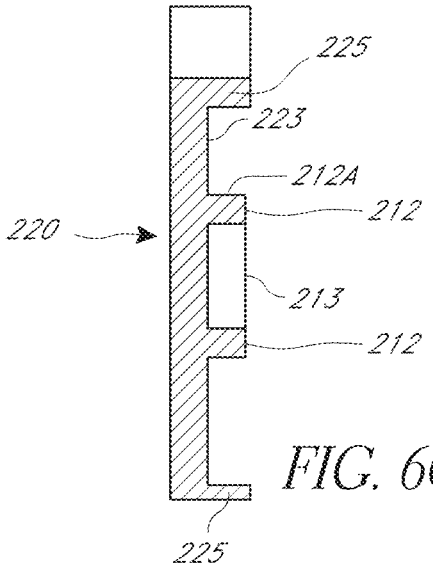
FIG. 6C is a sectional view taken along the line 6C in FIG. 6A.

FIG. 6B illustrates a side view of the chamber member 220 and the peripheral wall 225. FIG. 6C illustrates a cross-sectional view of chamber member 220 taken along the line 6C in FIG. 6A. In some embodiments chamber member 220 comprises an idler gear shaft 212 extending from interior surface 223. Optionally, the idler shaft 212 comprises an exterior surface 212*a* on which the timing idler gear 210 is configured to be rotatably coupled.

FIG. 6C shows a step in assembling the conversion kit comprising the chamber member 220 and the timing idler gear 210 with the engine 200. In some embodiments the idler gear 210 is configured to be rotatably mounted to the idler shaft 212. Optionally, the timing idler gear 210 is configured to be meshed with at least one of the crank gear 209 or the cam gear 205. In some embodiments of the conversion kit, the conversion kit comprises more than one timing idler gear 210 and a complete timing idler geartrain extending between the crank gear 209 and the cam gear 205. Optionally, chamber member 220 comprises a pry slot located proximate the idler gear shaft and configured to aid in the removal of the timing idler gear from the idler shaft.

Figure 6D:
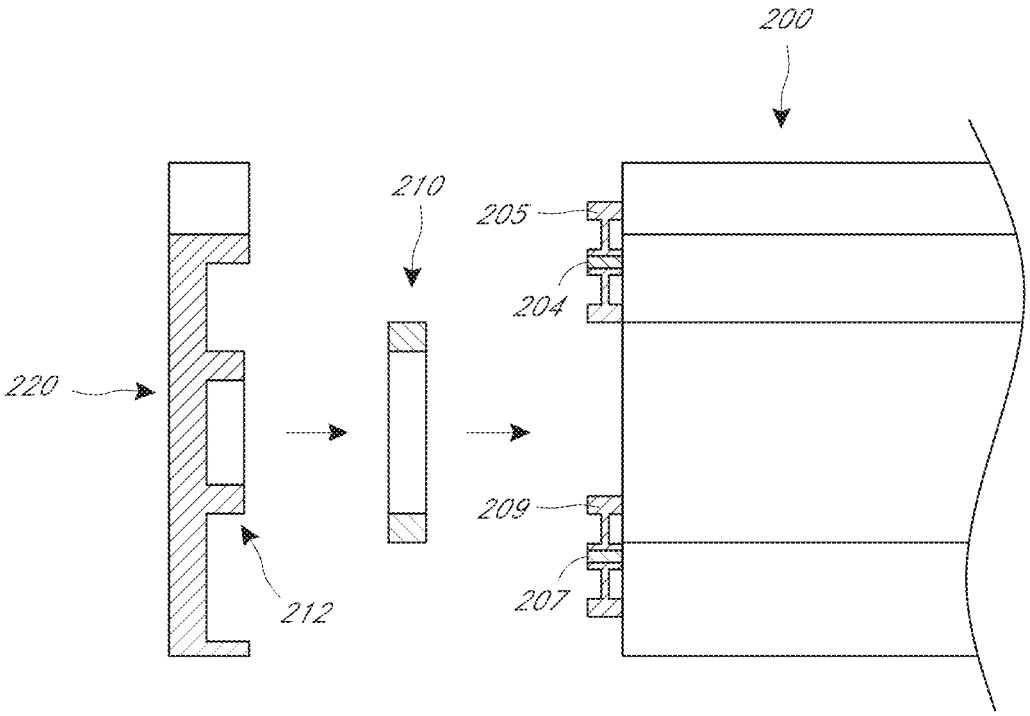
FIG. 6D is a side view of the chamber member of the kit illustrating a partially assembled kit.
Figure 6E:
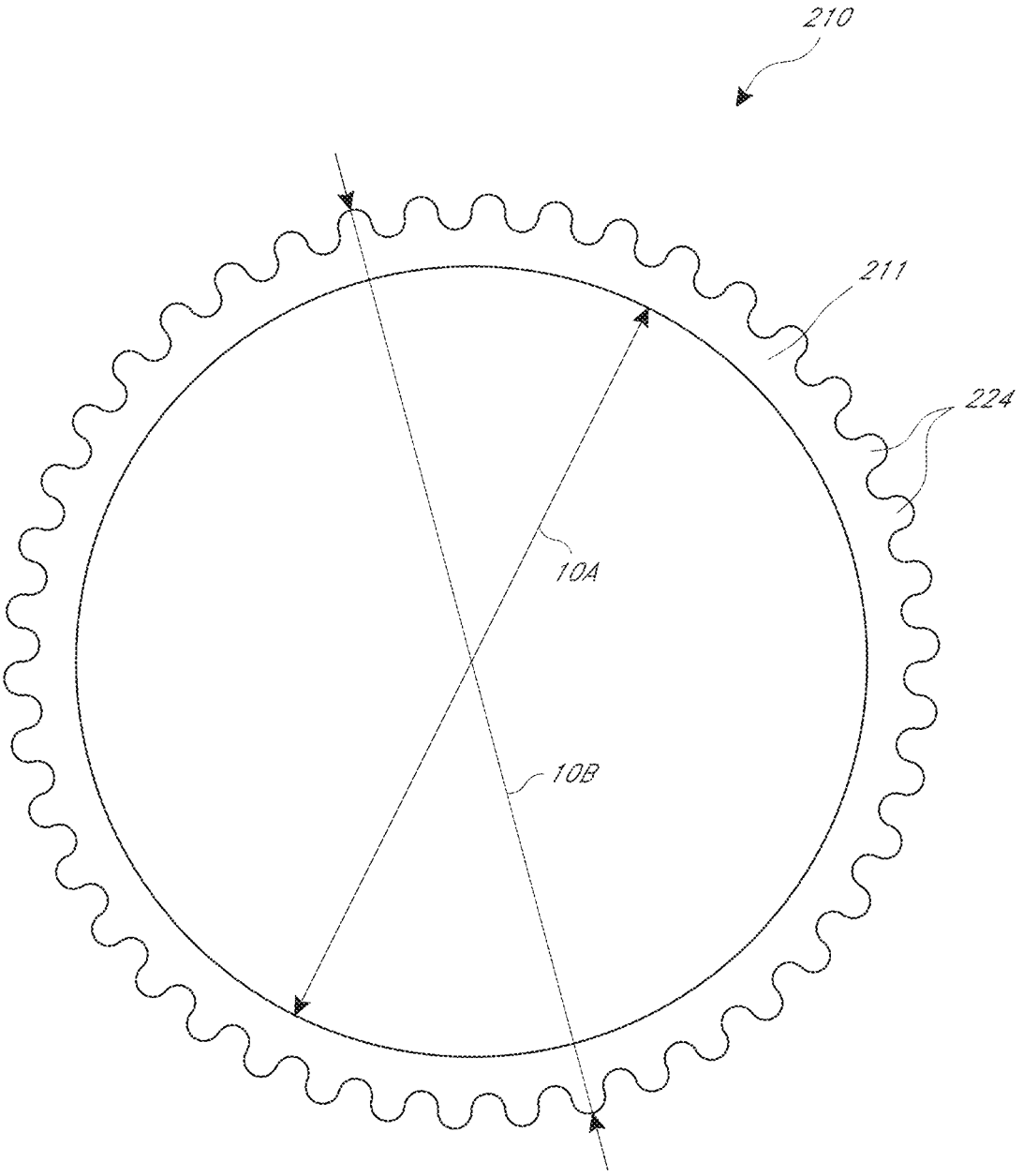
FIG. 6E is a schematic, top view of a timing idler gear comprising a rim gear.

FIG. 6D shows an embodiment of the timing idler gear 210 comprising a rim gear. The timing idler gear 210 as described herein can be used with any of the embodiments as described in the present disclosure including the embodiments shown in previous and subsequent figures. Furthermore, each of the applications of the timing idler gear 210 described herein can comprise a rim gear. Additionally, the timing idler gear 210 can comprise any type of gear tooth style including spur gear, beveled gear, herringbone gear, etc.

In some embodiments, the rim gear comprises a rim 211 and a plurality of teeth 224. Optionally, the rim gear is a gear without a hub and/or without both a hub and a webbing. In some embodiments the rim gear comprises an inside diameter 10*a* and an outside diameter 10*b*. Optionally, the inside diameter 10*a* is equal to or greater than approximately 50% of the outside diameter 10*b*. Still in other embodiments the inside diameter 10*a* is equal to or greater than approximately 75% of the outside diameter 10*b*. In still other embodiments the inside diameter 10*a* is equal to or greater than 90% of the outside diameter 10*b*. In still other embodiments the inside diameter 10*a* is between approximately 75% and 90% of the outside diameter 10*b*. As used herein, the term "rim gear" is intended to mean a gear without a webbing connecting the teeth to a hub and/or with an inside diameter is equal to or greater than approximately 50% of the outside diameter.

Additionally, for the purposes of this specification approximately means within five percentage points of whatever units are being measured. In some embodiments, the rim gear interior diameter 10*a* ranges between approximately 40% and 95% of the outside diameter 10*b*. In some embodiments, the rim gear interior diameter 10*a* ranges between approximately 50% and 90% of the outside diameter 10*b*. In other embodiments it ranges between 60% and 90% of outside diameter 10*b*. In other embodiments interior diameter 10*a* ranges between 70% and 85% of exterior diameter 10*b*. In other embodiments of either the rim gear 210, interior diameter ranges between 80% and 90% of the outside diameter 10*b*. In some embodiments, the inside diameter 10*a* is approximately 80% of the outside diameter 10*b*. In other embodiments, the inside diameter 10*a* is approximately 95% of the outside diameter 10*b*. In other embodiments, the inside diameter 10*a* is approximately 90% of the outside diameter 10*b*. In some embodiments, the inside diameter 10*a* is approximately 75% of the outside diameter 10*b*. In some embodiments, the inside diameter 10*a* is approximately 60% of the outside diameter 10*b*. In some embodiments, the inside diameter 10*a* is approximately 50% of the outside diameter 10*b*. In some embodiments, the inside diameter 10*a* is approximately 40% of the outside diameter 10*b*

Figures 7A, 7B, 7C:
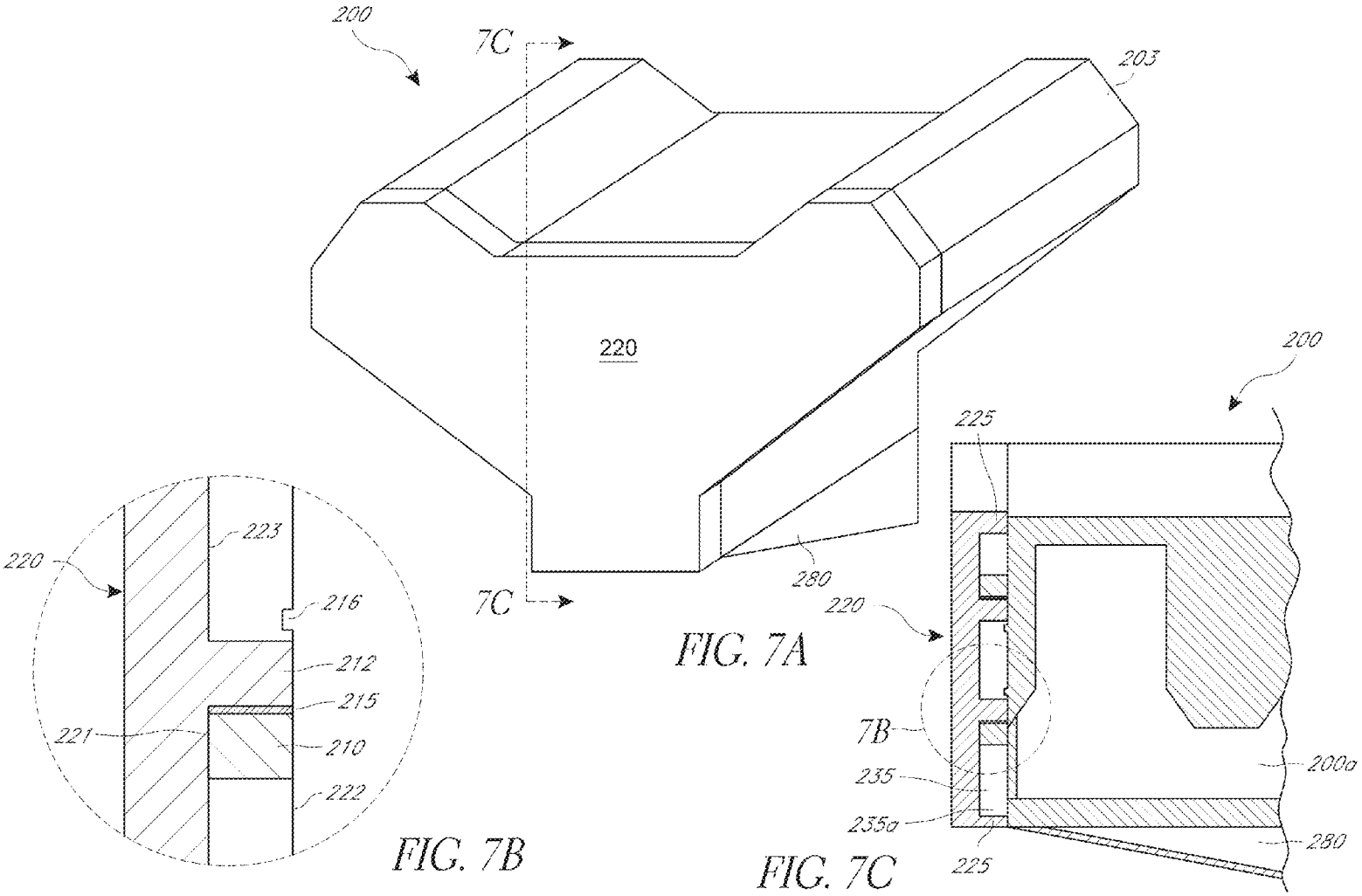
FIG. 7A is a schematic, perspective view of an assembled kit.
FIG. 7B is a detailed view of FIG. 7C.
FIG. 7C is a sectional view taken along the line 7C in FIG. 7A.

Referring now to FIG. 7A, FIG. 7A is a view of the conversion kit as shown in FIGS. 6A-6D in an assembled state.

In FIG. 7A, the engine chamber member 220 is fastened to engine housing wall 202 at a plurality of mounting locations (not shown) with the timing idler gear 210 rotatably coupled to the shaft 212 and meshed with one of the crank gear 209 or the cam gear 205. In some embodiments the chamber member 220 is mounted to the engine housing 202 with the idler shaft 212 extending from the interior surface 223 towards the housing wall 202. As discussed below with reference to FIG. 9, the idler shaft 212 can be mounted extending away from the housing wall 202 in some embodiments of the current disclosure.

Chamber member 220 optionally comprises a plurality of mounting locations around a perimeter of the chamber member 220 that correspond to a plurality of mounting locations on the engine housing walls 202. Optionally, at least some of the plurality of mounting locations are on a central portion of the chamber member 220.

In some embodiments, the engine 200 can also comprise the oil reservoir 280 containing an oil pump (not shown). Optionally, the oil reservoir 280 can be the oil reservoir used for collecting lubrication oil circulated to various components within the engine 200 with a lubrication system (not shown). For example, the oil pump draws oil from the reservoir 280 and pumps the collected lubricant to various oil galleries, bearings and other sliding components, such as cylinder walls, crankshaft bearings, camshaft beatings, valve stems, etc.

FIG. 7C is a sectional view of the assembly as shown in FIG. 7A taken along the line 7C. This sectional view shows the assembled conversion kit comprising the chamber member 220 fastened to the engine 200 and including idler gear 210 rotatably mounted on the outside surface 212*a* of the idler shaft 212. The engine 200 comprises an engine interior space 200*a* as represented in schematic form in FIG. 7C. The interior space 200*a* can be a lower portion of the engine block 201 or crankcase of the engine 200, to which lubrication oil returns after being pumped to various components within the engine 200.

In some embodiments, the chamber member 220 is configured to define a chamber 235 when it is placed against the housing wall 202 of the engine 200. Optionally, the chamber 235 encompasses the entire timing geartrain. Optionally, chamber 235 encompasses the timing idler gear 210 and the timing idler shaft 212. Optionally, the chamber 235 is created between the interior surface 223, the engine housing wall 202, and the peripheral wall 225. The peripheral wall 225 can be configured to abut against a front side such as the housing wall 202 of the engine 200, so as to maintain the chamber member 220 at a predetermined spacing away from the front surface and thus define an enclosed or partially enclosed chamber around the timing geartrain. Optionally, the peripheral wall is configured to match the contours of the front of the engine 200. In some embodiments, the peripheral wall is uneven to match an uneven engine front. In other embodiments, the peripheral wall is even to match an even or uniform engine front.

In some embodiments the conversion kit further comprises an oil gasket. Optionally, the oil gasket is configured to be placed between the chamber member 220 in the engine housing wall 202. Optionally, the oil gasket is configured to be mounted between the peripheral wall 225 and the engine housing wall 202. The oil gasket functions to create an oil seal about the chamber 235. This has the advantage of creating a self-enclosed lubrication chamber. In some embodiments, the chamber 235 comprises an oil reservoir 235*a* in a lower portion of the chamber 235.

FIG. 7B, is a detail view of FIG. 7C. According to some embodiments of the conversion kit, chamber member 220 and idler shaft 212 can be aligned with engine 200 by at least one mounting tab 216 included in the kit. Mounting tab 216 can constitute a projection from engine housing 200 and functions to align chamber member 220 with engine 200 during assembly of the kit. Optionally, a honed surface 221 can be included on the interior surface 223 near idler shaft 212 to reduce friction between timing idler gear 210 and interior surface 223. Optionally, honed surface 222 can be included on engine housing 202 to reduce friction between idler gear 210 and engine housing 202.

In some embodiments of the conversion kit, a bearing 215, such as a needle or ball bearing is mounted to the exterior surface 212*a* of the idler shaft 212 to reduce friction between idler shaft 212 and idler gear 210. In other embodiments, the bearing 215 can be a plain, sleeve, or hydrodynamic bearing. Optionally, exterior surface 212*a* is honed to reduce friction between idler gear 210 and idler shaft 212. In the form of plain or sleeve bearings, the bearing 215 can have a polished surface corresponding to the outer surface 212*a* of the idler shaft 212, optionally lubricated with grease or oil. In some embodiments, oil for the bearing 215 is supplied continuously during operation so that the idler gear 210 rotates on a thin oil film, optionally, under the principle of operation of a hydrodynamic bearing.

Figure 8B:
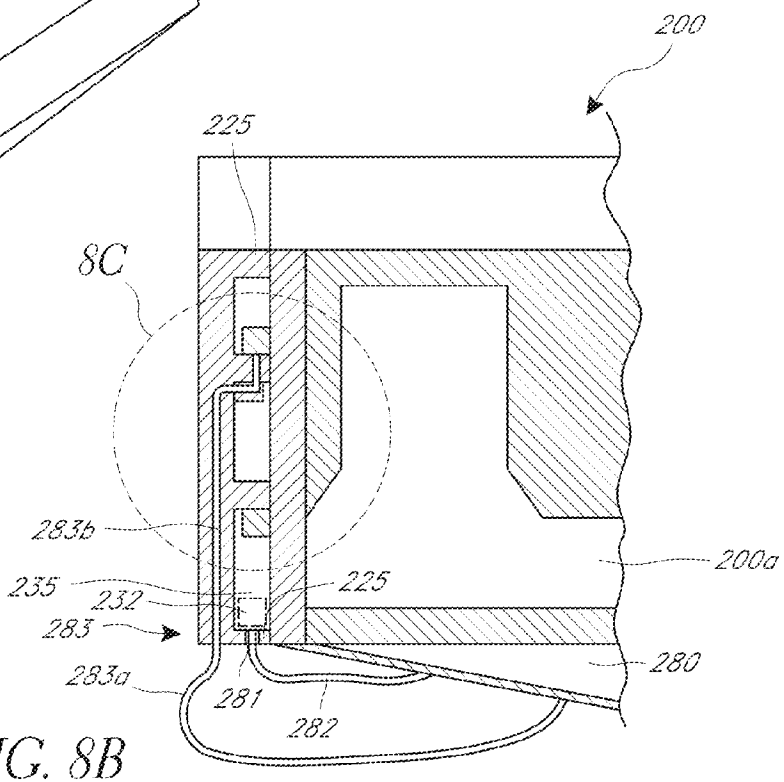
FIG. 8B is a sectional view taken along the line 8B in FIG. 8A.
Figure 8A:
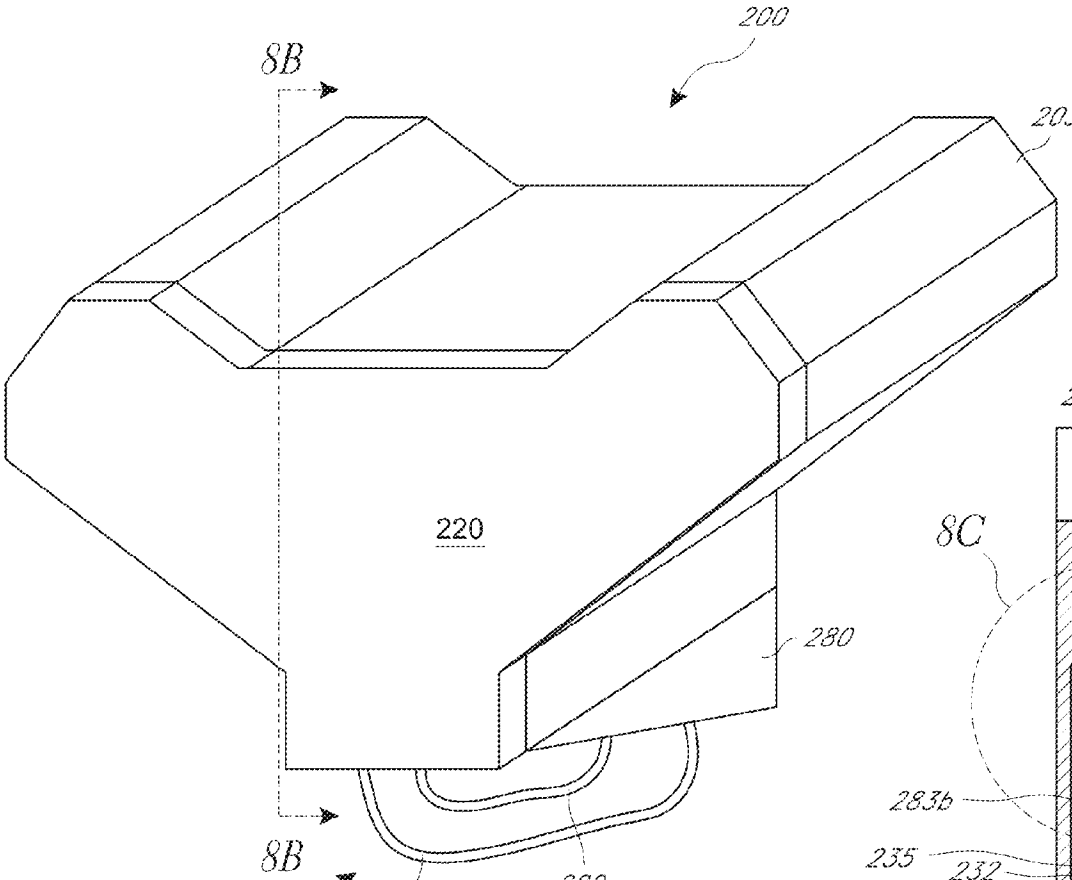
FIG. 8A is a schematic, perspective view of another embodiment of a partially assembled kit.

Referring now to FIGS. 8A and 8B, FIG. 8A is an embodiment of an assembly view of the conversion kit for converting an internal combustion engine to an overhead cam engine using a timing idler gear and including components of a lubrication system. In some embodiments, the conversion kit comprises an oil supply line 283 extending between the oil reservoir 280 and the chamber member 220. Optionally, the oil supply line 283 comprises an exterior portion 283*a* fluidly coupled with the oil reservoir 280 and an interior portion 283*b* fluidly coupled with the exterior surface 212*a* of the idler shaft 212. Optionally, the exterior portion 28*a* can be fluidly coupled with the oil pump contained in the oil reservoir 280, for example, with oil supply line 283.

In some embodiments of the conversion kit, an oil supply return line 282 can be fluidly coupled at a first end with the chamber oil reservoir 235*a*. Optionally, a second end of the return line 282 can be fluidly coupled with the reservoir 280 and function to return the supply of oil pumped into the chamber 235 by the oil supply line 283. Optionally, the return line 282 is coupled at the bottom of the chamber 235 at a drain 281. In some embodiments, the return line 282 may comprise an exterior portion and/or an interior portion through the engine 200 or the chamber member 220.

Figure 8C:
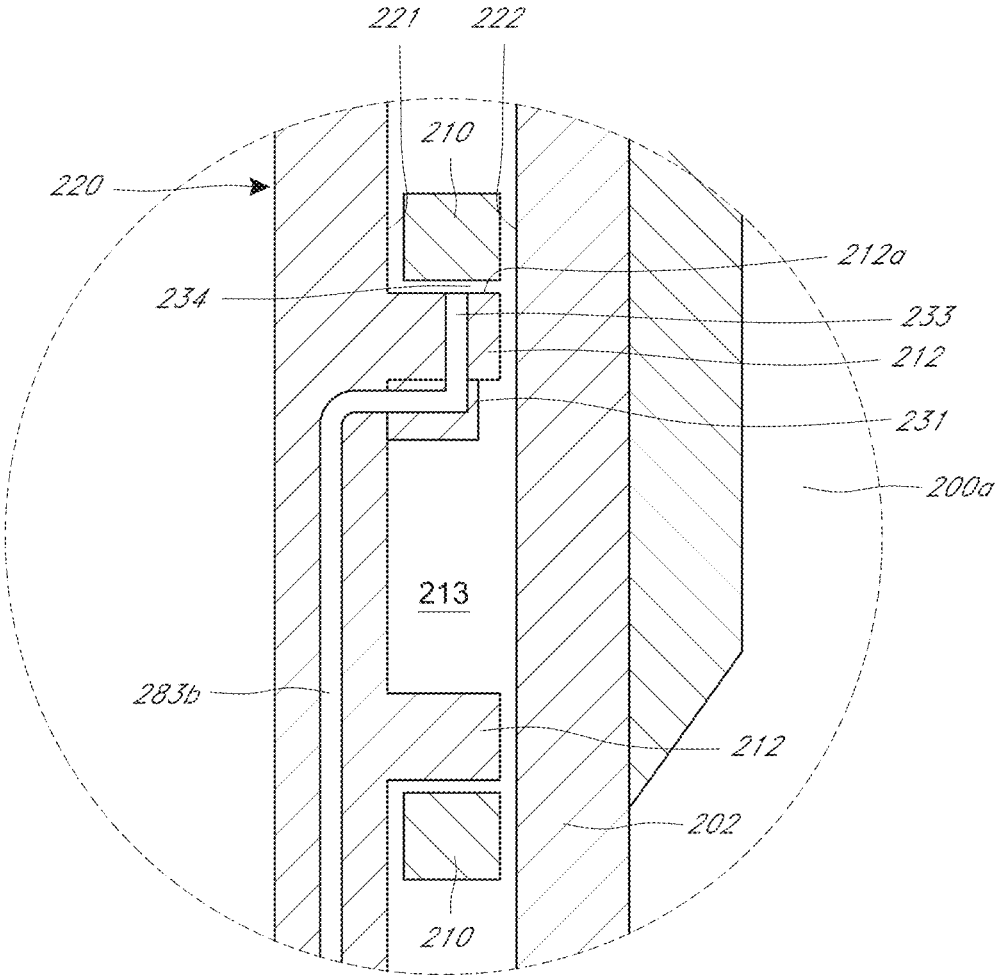
FIG. 8C is a detailed view of FIG. 8B.

With reference to FIG. 8C, in some embodiments, the oil supply line 283 is fluidly coupled with a lubrication space 234 located between the idler gear 210 and the exterior surface 212*a* of the idler shaft 212. In some preferred embodiments, the oil supply line 283 is configured to deliver a supply of oil to lubricate the idler gear 210. Optionally, the chamber member 220 can be configured to allow the oil supplied to the lubrication space 234 to drip from the lubrication space 234 and collect in the oil reservoir 235*a*. Optionally, the oil supply returns to the oil reservoir 280 through the drain 281 and the return line 282. The oil supply can thus be recirculated through the oil supply line 283.

In a preferred embodiment, the interior portion 283*b* of the oil supply line extends through a wall portion of the chamber member 220. Optionally, interior oil line 283*b* is created by gun drilling through wall portions of the chamber member 220 and plugging unnecessary exterior holes left in the wall portions. As illustrated in FIG. 8C, the interior portion 283*b* can comprise an extension line 233 fluidly coupled with the exterior surface 212*a* through the boss 231. Optionally, the boss 231 can be created as an original part of the idler shaft 212 as illustrated in FIG. 6A. The extension 233 can be created by drilling through the boss 231 and idler shaft 212 and plugging any exterior holes created by the drilling process. In other embodiments, interior oil line 283*b* extends directly through the idler shaft 212*a* to the exterior surface 212*a* without the boss.

In some embodiments of the conversion kit, the lubrication system is self-enclosed (as described in greater detail below in reference to FIG. 9E) wherein the oil supply is recirculated independent of the lubrication system of the engine 200. Optionally, the conversion kit comprises an oil pump 232 that pumps oil from within the chamber 235 through the oil supply line 283 and up to the lubrication space 234. Optionally, the oil pump is located in the chamber 235. Optionally, the oil pump is located exterior to the chamber 235. Optionally, the oil supply line 283 is fluidly coupled with the oil reservoir 235*a*. In such a configuration, the oil return line 282 can be omitted from the conversion kit. Optionally, the oil reservoir is located exterior to the chamber 235. Optionally, the oil pump is configured to pump the oil supply through the interior portion 283*b*. Optionally, the interior portion 283*b* comprises the extension 233 and/or the boss 231 as described above. Thus, the oil supply line 283 can deliver a supply of oil to the lubrication space 234 without utilizing the oil supply of the engine 200.

Figure 9A:
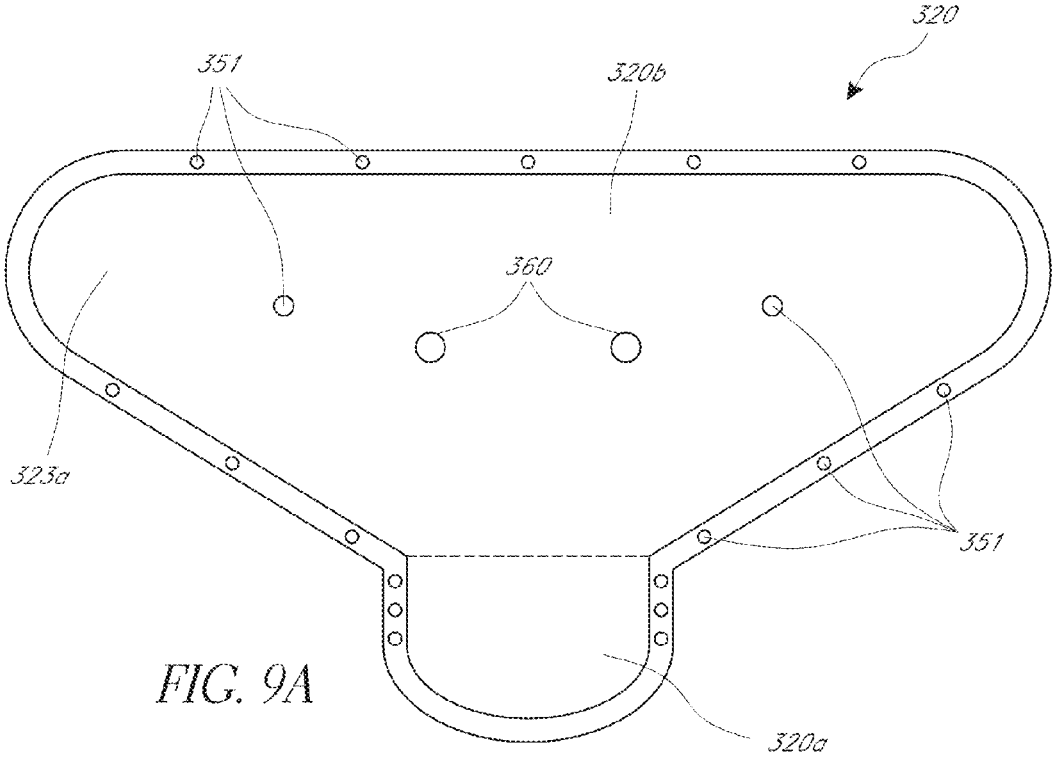
FIG. 9A is a schematic illustration of a second chamber member in an embodiment of a kit for replacing a conventional valvetrain in an existing engine using at least one timing idler gear.
Figure 9B:
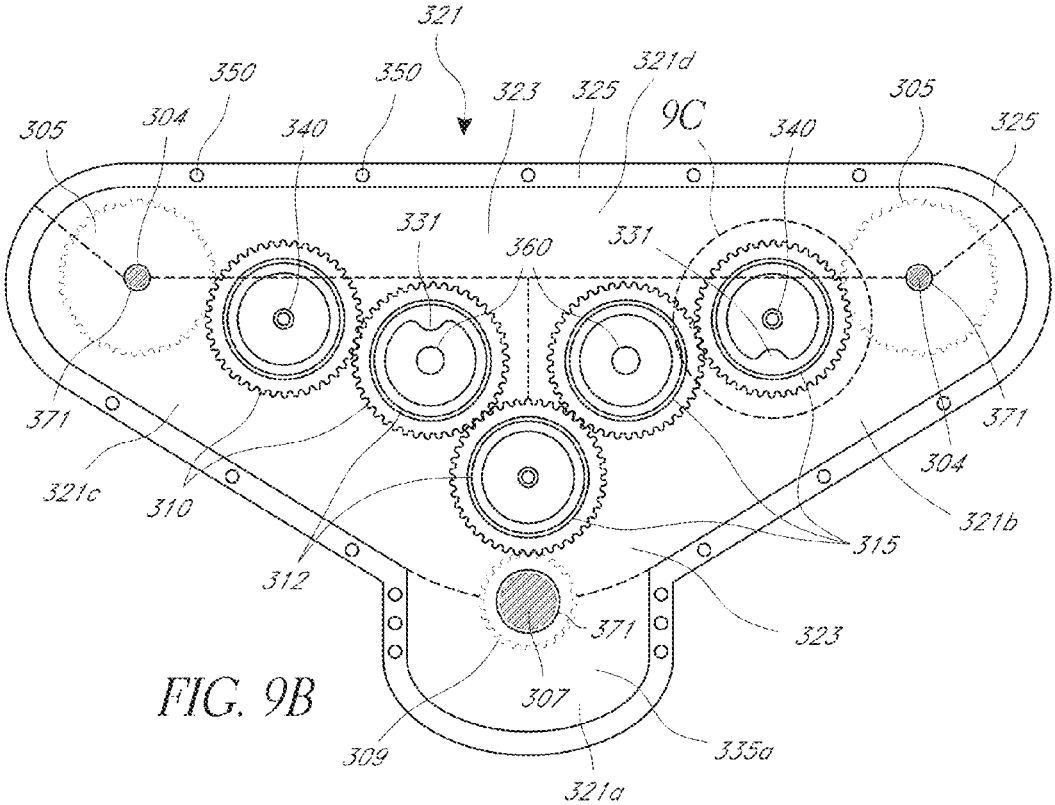
FIG. 9B is a front view of the kit of FIG. 9A showing a partially assembled kit.
Figure 9C:
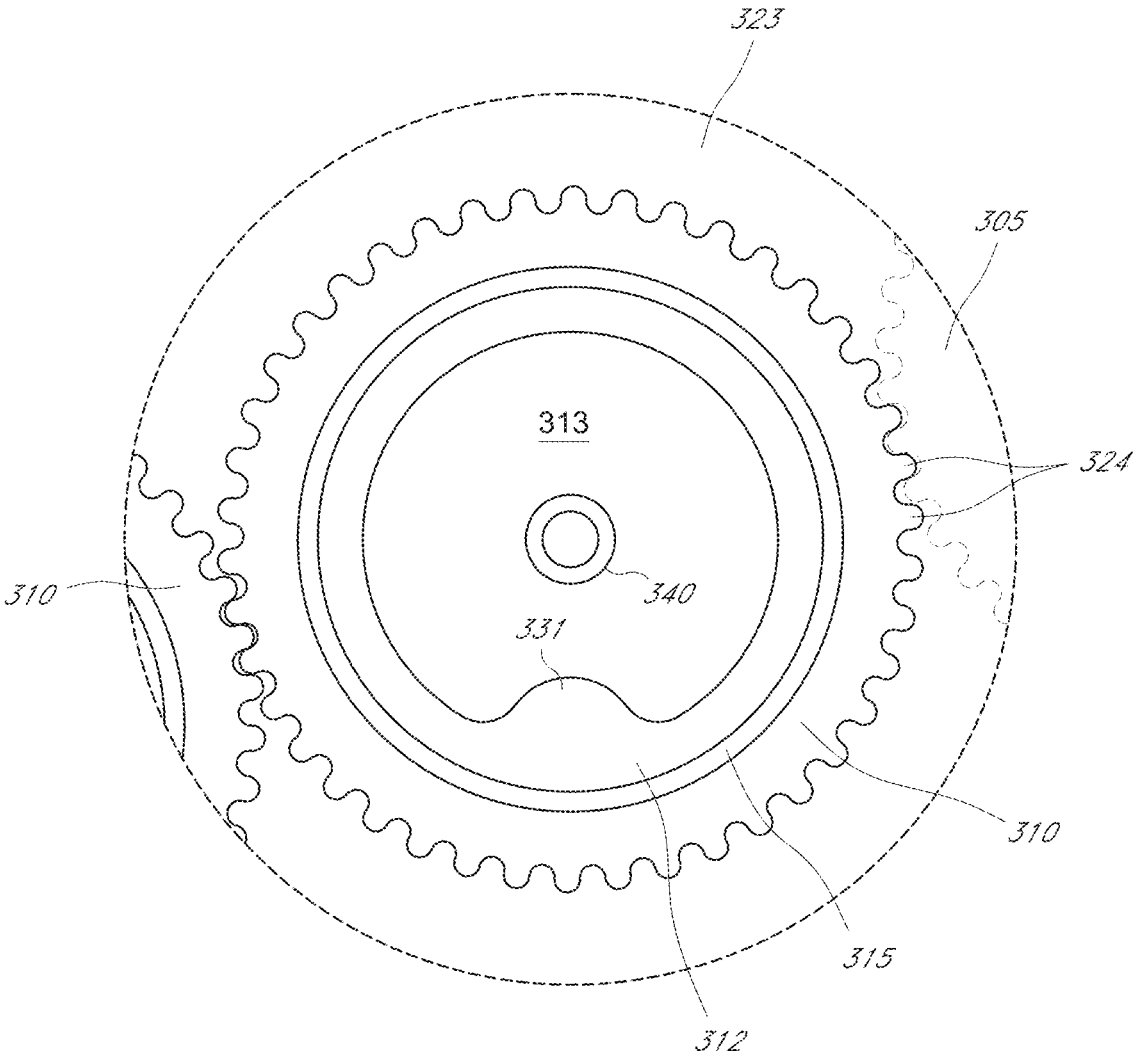
FIG. 9C is a detailed view of FIG. 9B.
Figure 9D:
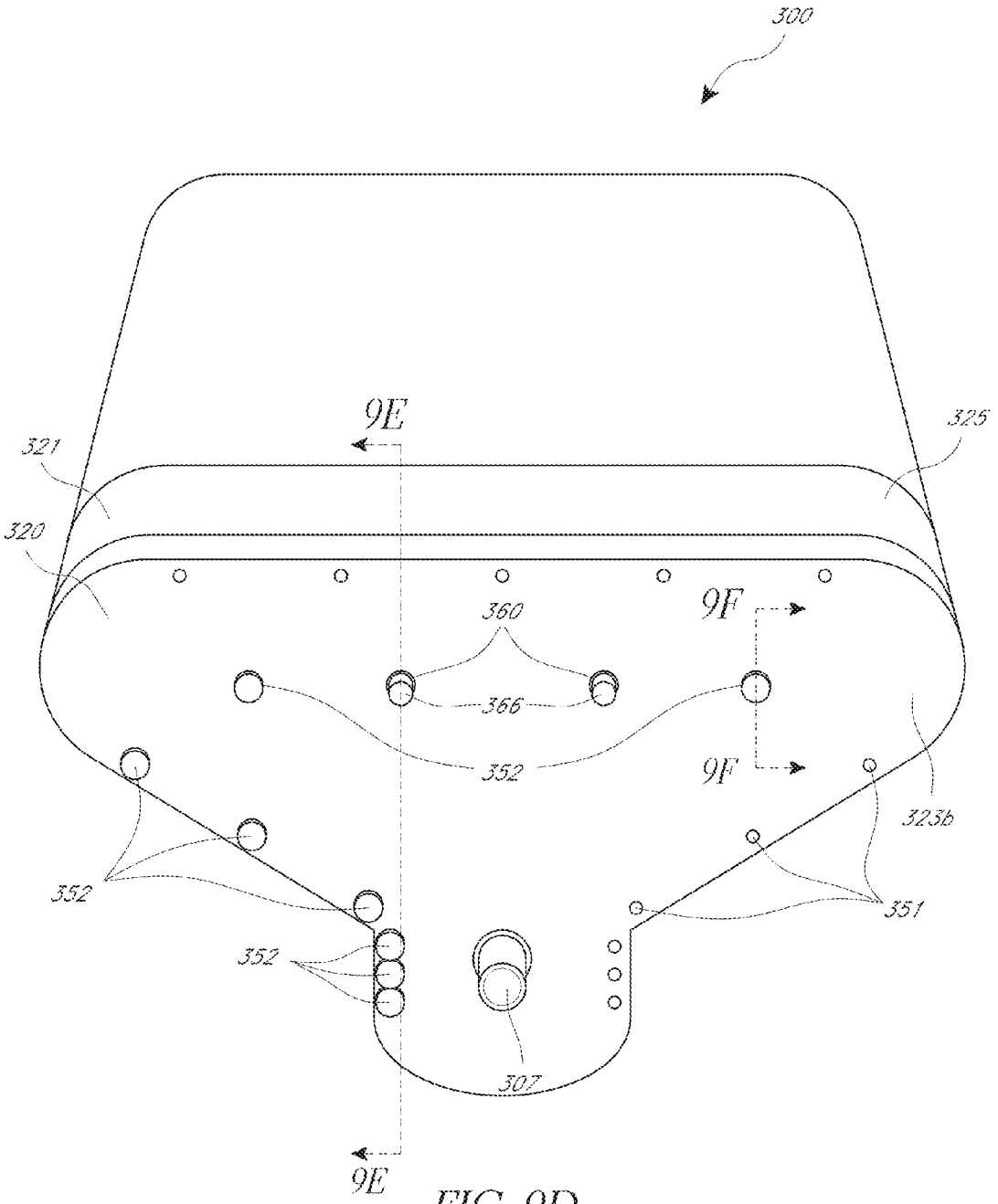
FIG. 9D is a schematic, perspective view of another embodiment of a partially assembled kit.

FIGS. 9A-9G illustrate another embodiment of a conversion kit comprising a first chamber member 321 that includes at least one idler shaft 312 extending from an interior surface 323 (FIG. 9B). Each of the features and constructions of the first embodiment as described in FIGS. 6-8 can also be incorporated in this second embodiment as shown in FIGS. 9A-9G. In some embodiments, the first chamber member 321 is configured to be mounted to an engine housing 302 of an engine 300 with the idler gear shaft 312 extending away from the engine 300 (FIG. 9D). A second chamber member 320 (FIG. 9A) is optionally used as a cover to create a chamber 335 between the first chamber member 321 and the second chamber member 320.

With continued reference to FIG. 9A, the second chamber member 320 is optionally configured to be mounted to the first chamber member 321 at a plurality of cover mounting locations 351. Optionally, the cover mounting locations 351 are on a perimeter of the second chamber member 320. Optionally, the cover mounting locations 351 comprise at least one central mounting location. Optionally, the second chamber member 320 comprises a flat plate or a contoured plate. Optionally, the second chamber member 320 comprises a top half 320*a* and a bottom portion 320*b* wherein the top portion 320*a* and the bottom portion 320*b* are separable and independently mountable to the first chamber member 321. Optionally, the bottom portion 320*b* is configured to be left in place when the top portion 320*a* is removed from the engine 300. In those embodiments where the chamber 335 comprises an oil supply, the bottom portion 320*b* can retain the oil supply within the chamber even when the top portion 320*a* is removed, for purposes such as maintenance of the geartrain.

The second chamber member 320 can further comprise at least one passageway 360 from an interior surface 323*a* to an exterior surface 232*b* of the second chamber member 320. Each of the passageways 360 can be placed at a location on the second chamber member 320 to align with a power take off shaft 366 when assembled with the first chamber member 321. The power take off shaft 366 is further described below in relation to FIGS. 9E, 9G, and 10. In some embodiments, the passageway 360 is configured such that the power takeoff shaft 366 extends through the second chamber member.

FIG. 9B depicts an elevational view of an embodiment of the conversion kit showing the first chamber member 321 having idler gears 310 configured to be meshed with a crank gear 309, a crankshaft 307, and with other idler gears 310 to form a geartrain for transferring torque from the crankshaft 307 to the camshaft 304, with the second chamber member 320 removed.

In some embodiments the first chamber member 321 comprises a plurality of engine mounting locations 350 that are configured to mount the first chamber member to the engine 300 with the idler shafts 312 extending away from the engine. Optionally, the engine mounting locations 350 can be spaced around the perimeter of the second chamber member 320. In some embodiments, the cover mounting locations 351 can also correspond to the engine mounting locations 350. In a preferred embodiment, at least some of the engine mounting locations 350 are separate from at least some of the cover mounting locations 351 such that the first chamber member 321 can be assembled with the engine 300 before the second chamber member 320 is assembled with the first chamber member 321.

In some embodiments, idler shafts 312 of the first chamber member include at least one interior mounting shaft 340. Optionally, the interior mounting shaft 340 acts as the central mounting location 351 for the second chamber member 320 to attach to the first chamber member 321. Optionally, the interior mounting shaft 340 comprises a standalone shaft extending from the interior surface 323 of the first chamber member 321. Alternatively the interior 313 of the idler shaft 312 is a solid volume and the interior mounting shaft 340 comprises a hole within the solid volume.

In some embodiments first chamber member 321 comprises a peripheral wall 325. Optionally, the peripheral wall 325 extends all the way around a perimeter of the first chamber member 321. Optionally, the peripheral wall 325 is configured to comprise the mounting locations 350. In some embodiments, the second chamber member 320 comprises the peripheral wall 325. In some embodiments, the peripheral wall 325 is split between the first and the second chamber members 321, 320.

As noted above, in some embodiments the first and second chamber member 321 and 320 are configured to create an interior chamber 335. Optionally, the conversion kit includes a gasket that can be placed between the first chamber member and the second chamber member 320 such that the chamber 335 can comprise an oil reservoir 335*a*. Optionally, oil reservoir 335*a* can comprise a lower portion of the chamber 335 specifically configured to collect oil. Optionally, the oil reservoir is exterior to the chamber 335 and is fluidly connected to the chamber 335.

In some embodiments of the conversion kit, the first chamber member 321 further comprises at least one access hole corresponding to one of the camshaft 305 and the crankshaft 307. The access holes 371 can provide the crank and cam gears 305, 309 access within the chamber 335. Optionally, at least one of the cam gear 305 or the crank gear 309 is removed from the shafts 304, 307 during the assembly of the conversion kit with the engine 300 such that the first chamber member 321 can be mounted to the engine 300. Optionally, the first and second chamber members 321, 320 are configured such that the cam gear 305 and the crank gear 309 are entirely enclosed within the chamber 335 when assembled together. Optionally, the first chamber member 321 comprises at least two separate portions 321*a*, 321*b* that can be assembled around the camshaft 305 and/or the crankshaft 307. One possible division of the first chamber member 321 is as indicated by the dashed lines in FIG. 9B.

FIG. 9C depicts a detail of FIG. 9B in the assembled state. In some embodiments of the conversion kit, a bearing 315, such as a needle or ball bearing is mounted to the exterior surface 312*a* of the idler shaft 312 to reduce friction between idler shaft 312 and idler gear 310. In other embodiments, the bearing 315 can be a plain, sleeve, or hydrodynamic bearing. Optionally, exterior surface 312*a* is honed to reduce friction between idler gear 310 and idler shaft 312. In the form of plain or sleeve bearings, the bearing 315 can have a polished surface corresponding to the outer surface 312*a* of the idler shaft 312, optionally lubricated with grease or oil. In some embodiments, oil for the bearing 315 is supplied continuously during operation so that the idler gear 310 rotates on a thin oil film, optionally, under the principle of operation of a hydrodynamic bearing.

In some embodiments idler gear shaft 312 further comprises a boss 331. The boss 331 can optionally comprise an extension 333 to an oil supply line 383 as described below.

FIG. 9D depicts an assembly view showing the first chamber member 321 mounted onto the engine 300 at the plurality of engine mounting locations 350 and the second chamber member 320 mounted at the plurality of cover mounting location 351 to the first chamber member 321 by a plurality of mechanical fasteners 352. Optionally, first chamber members 321 can be directly mounted to engine 300 at an engine housing 302 of the engine 300. The shafts 310 are optionally pointed away from engine 300. Optionally, the second chamber member 320 acts as a cover to create chamber 325. Such a configuration allows for easy and convenient access to the geartrain of the conversion kit by removing the second chamber member 320. Optionally, only the top portion 320*b* of the second chamber member 320 need be removed to provide access to the idler gear 310. In such a configuration, the oil reservoir 335*a* formed by bottom portion 320*a* can be optionally maintained with an oil supply contained within it when the top portion 320*b* is removed.

In some embodiments the passageway 360 can provide a pathway for the power takeoff shaft 366 to extend up to or beyond an exterior surface 323*b* of the second chamber member 320.

Figure 9E:
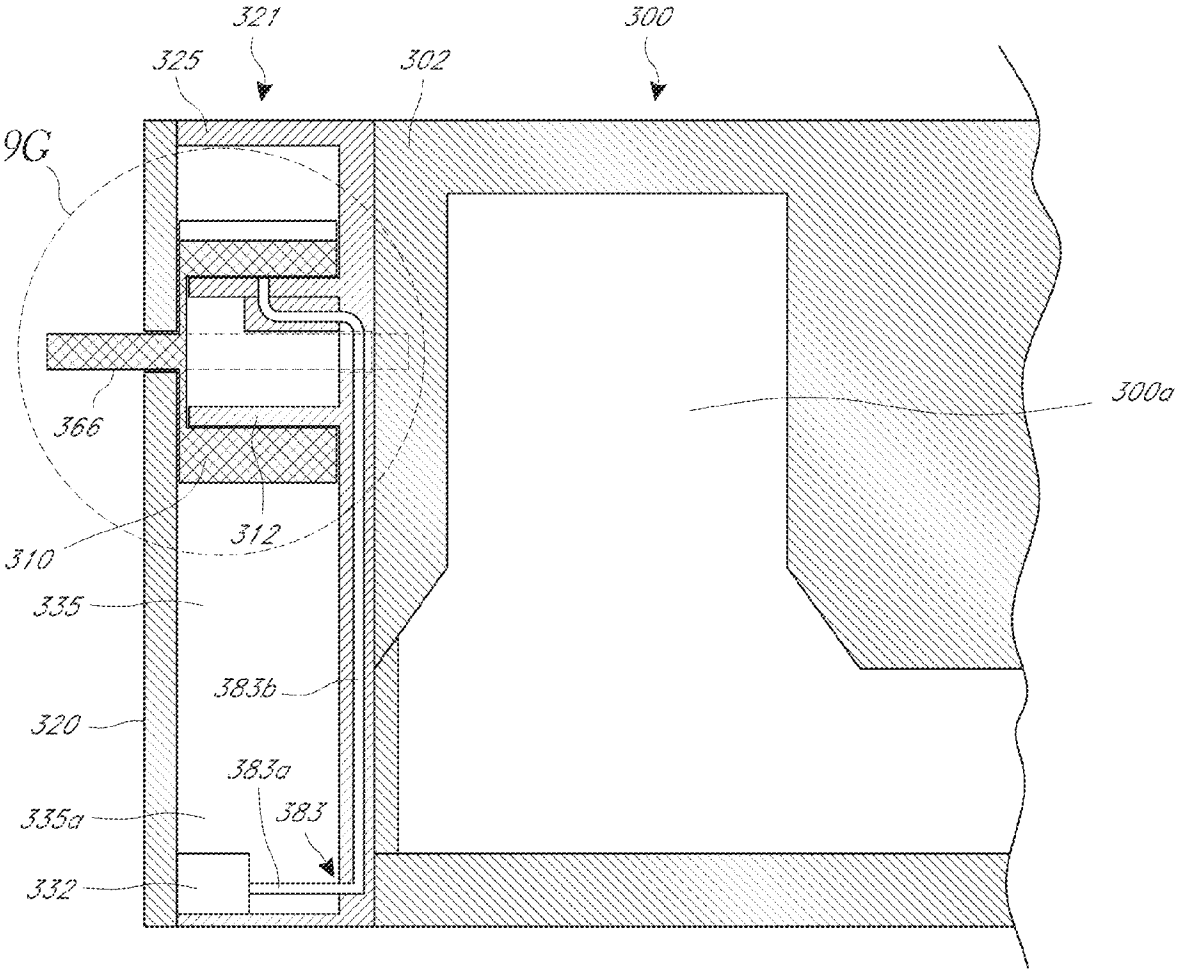
FIG. 9E is a sectional view taken along the line 9E in FIG. 9D.

FIG. 9E depicts a sectional view of the assembly shown in FIG. 9D. FIG. 9G depicts a detail view of FIG. 9E. With reference to FIGS. 9G and 9E, the idler gear 310 is rotatably coupled with the idler gear shaft 312. Optionally, the power takeoff shaft 366 extends from a faceplate 311 rigidly attached to the timing idler gear 310. Optionally, the timing idler gear comprises a rim gear. Optionally, a second power takeoff shaft 366*a* can be coupled with the faceplate 311 and extend in a direction opposite the power takeoff shaft 366. Optionally, when the power takeoff shaft 366*a* extends in the direction opposite the power takeoff shaft 366, a second passageway 360*a* can be made in the first chamber member 321 and aligned with the second power takeoff shaft 366*a*.

The embodiments of FIGS. 9E and 9G and described above can be used with any of the different embodiments of the conversion kit or engine described herein.

In some embodiments of the conversion kit, the timing idler gear 310 is held substantially in place on the idler gear shaft 312 by an interior surface 323*a* of the second chamber member 320. Optionally, a honed surface 322*a* can be included on the second chamber member 320 to reduce friction between idler gear 310 and the second chamber member 320. Optionally, a honed surface 322 of the first chamber member 321 can be used to reduce friction between the idler gear 310 and the first chamber member 321.

With continued reference to FIGS. 9E and 9G, the conversion kit can comprise a lubrication system for delivery a supply of oil to the rotating timing idler gear 310. In some embodiments an oil supply line 383 is fluidly coupled with an oil reservoir 335*a* on one end and a lubrication space 334 on the other end and configured to deliver a supply of oil through the oil supply line 183.

In some embodiments of the conversion kit, the kit comprises a self-contained lubrication system wherein the oil supply is recirculated independent of the lubrication system of the engine 300. Optionally, the conversion kit comprises an oil pump 332 that pumps oil from within the chamber 335 through the oil supply line 383 and up to the lubrication space 334. Optionally, the oil pump is located in the chamber 335. Optionally, the oil pump is located exterior to the chamber 335. Optionally, the oil supply line 383 is fluidly coupled with the oil reservoir 335*a* at the bottom of the chamber 335. Optionally, the oil reservoir is located exterior to the chamber 335 or in another location within the chamber 335. Optionally, the oil pump is configured to pump the oil supply through an interior portion 283*b* of the oil supply line 383. Optionally, the interior portion comprises a passageway through either of the first or second chamber members 320, 321. Optionally, the interior portion 383*b* comprises the extension passageway 333 and/or passes through the boss 331. Optionally, the oil supply line 383 can deliver a supply of oil to the lubrication space 334 directly through the idler shaft 312 without a boss.

In some other embodiments of the conversion kit, the lubrication system is coupled with the existing lubrication system of the engine 300. Thus the conversion kit may comprise an oil supply line 383 fluidly coupled with an oil reservoir 380 (similar to oil reservoir 280) and the lubrication space 334. Optionally, the conversion kit also comprises a return line 382 fluidly coupled between the oil reservoir of the kit 335*a* at a drain 381 and the oil reservoir 380.

Figure 9F:
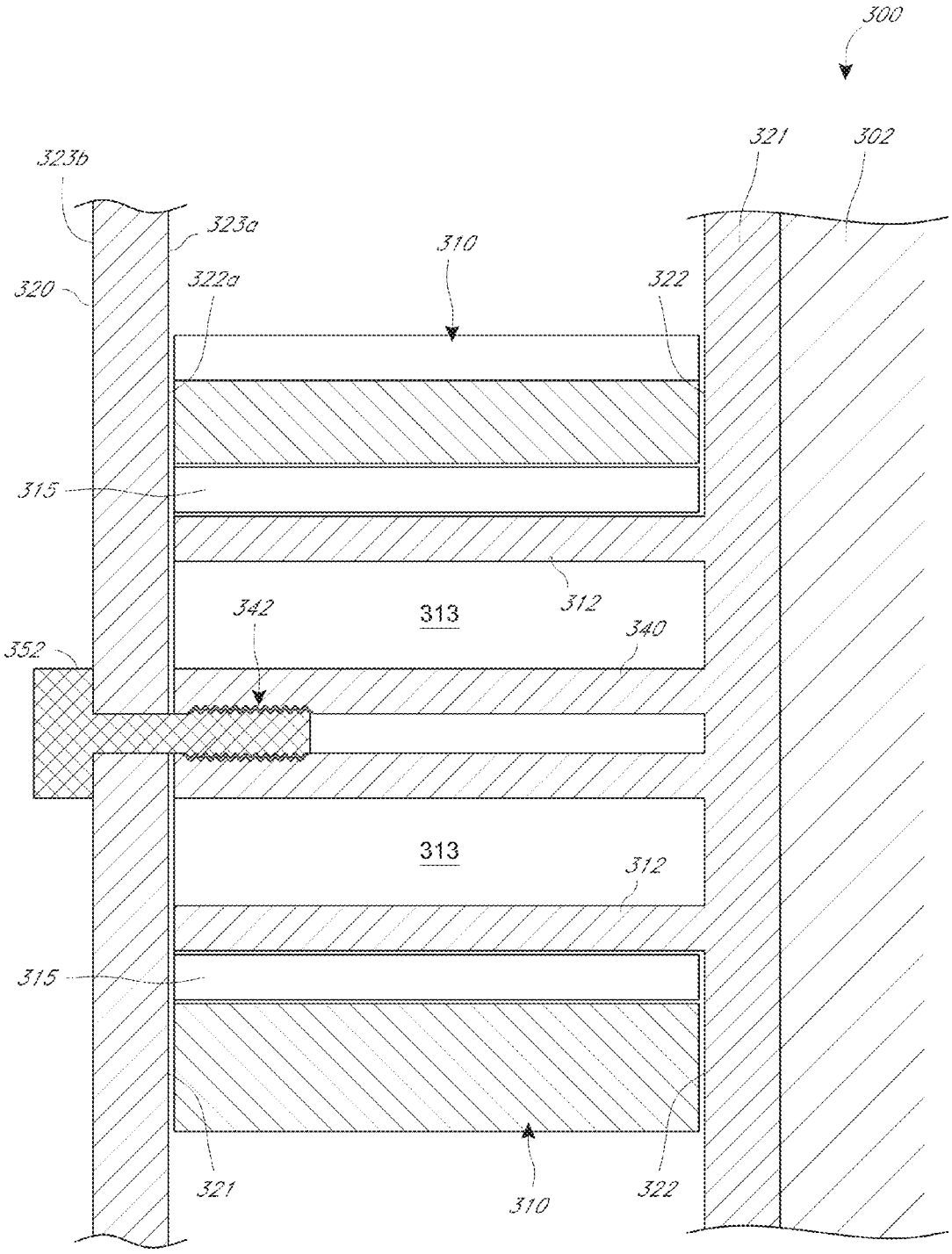
FIG. 9F is a detailed section view taken along the line 9F is FIG. 9D.
Figure 9G:
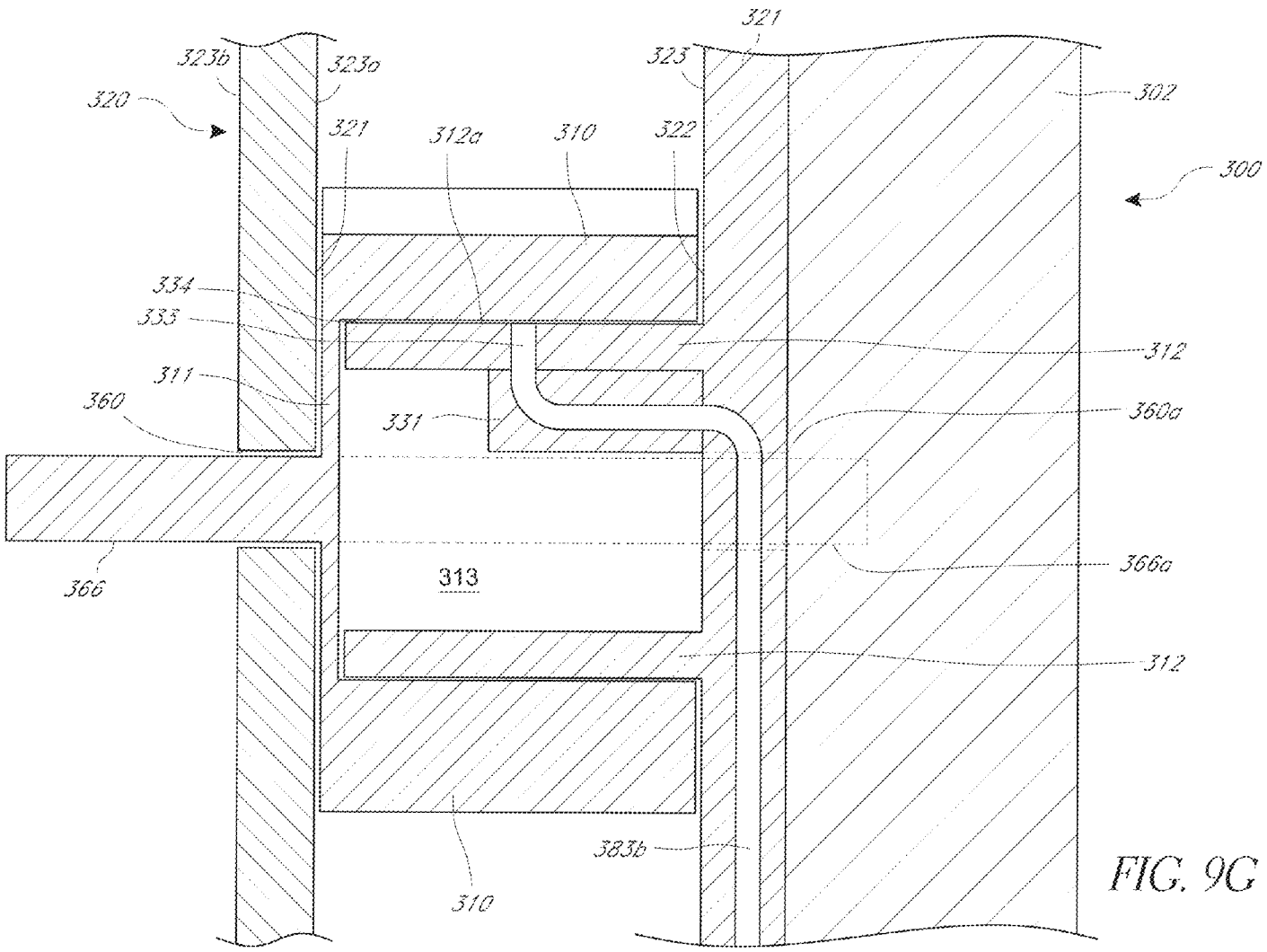
FIG. 9G is a detailed view of FIG. 9E.

FIG. 9F depicts a partial sectional view of the assembly of FIG. 9D showing one of the mechanical fasteners 352 and one of the interior mounting shafts 340. Optionally, idler gear 310 is rotatably coupled to idler shaft 312 through bearing 315. Optionally, the mechanical fastener 352 can be used to secure the second chamber member 320 to the interior mounting shaft 340 by threads 342. Optionally, interior space 313 comprises an empty space, but in other embodiments comprises a solid volume. Optionally, the interior space 313 comprises the interior mounting shaft 340 and/or the threads 342.

Figure 10:
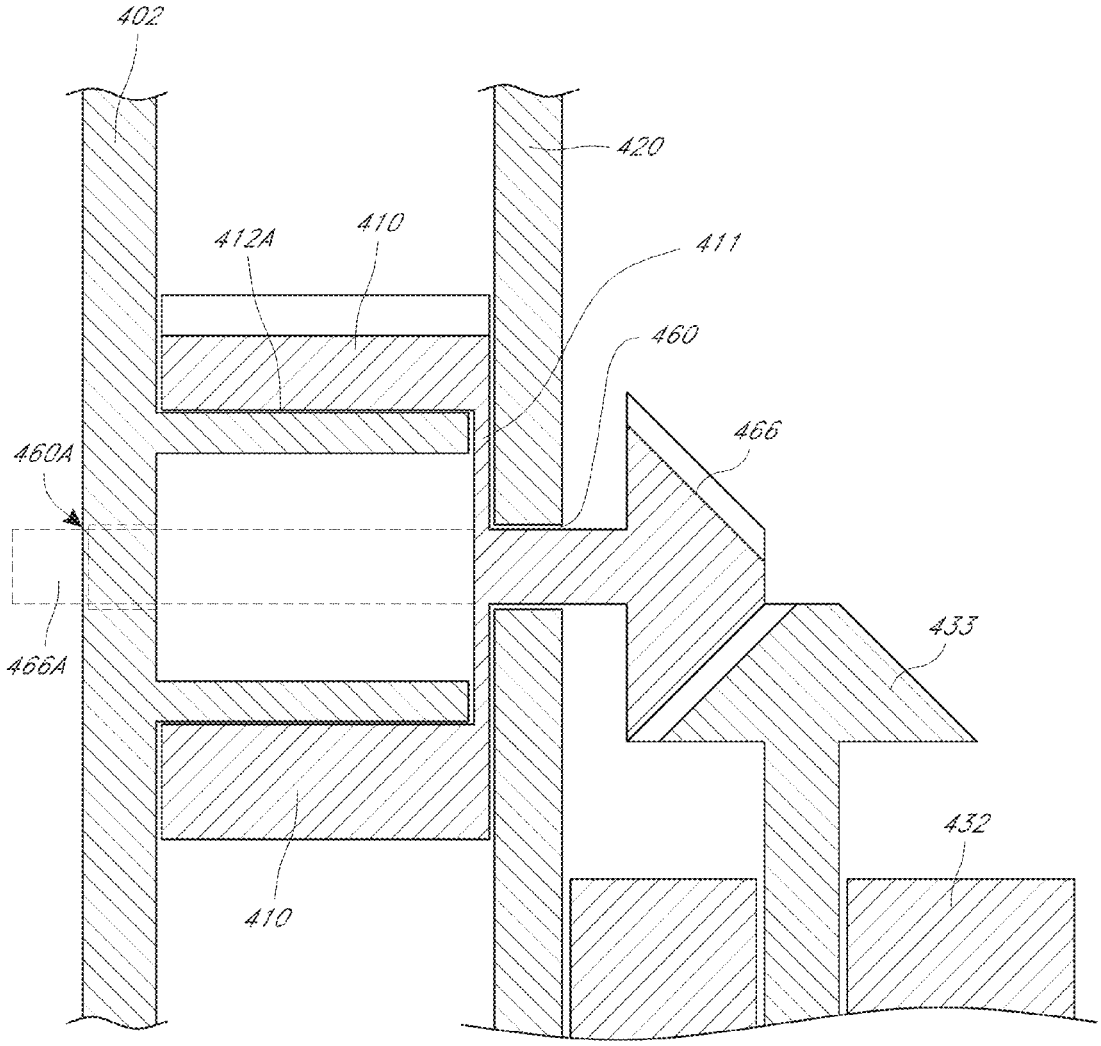
FIG. 10 is a sectional view of an embodiment of a power takeoff shaft compatible with each of the embodiments shown and described herein.

FIG. 10 depicts another embodiment of a power takeoff assembly which is compatible with each of the embodiments of the conversion kit and engines described herein. Optionally, the idler gear 410 is rotatably mounted to an idler shaft 412 with a faceplate 411 fixedly coupled with the idler gear 410. Optionally, extending from the faceplate 411 is a power takeoff shaft 466. Optionally, a power takeoff shaft 466 can comprise a beveled gear configured to mesh with a second beveled gear 433 and provide torque to an engine accessory 432. Optionally, the power takeoff shaft 466 can extend through a passageway 460 through a chamber member 420. Optionally, the engine accessory 432 can be fixedly mounted to the chamber member 420. Optionally, the idler shaft 412 extends from one of the first or the second chamber members or from the engine housing wall.

Figure 11:
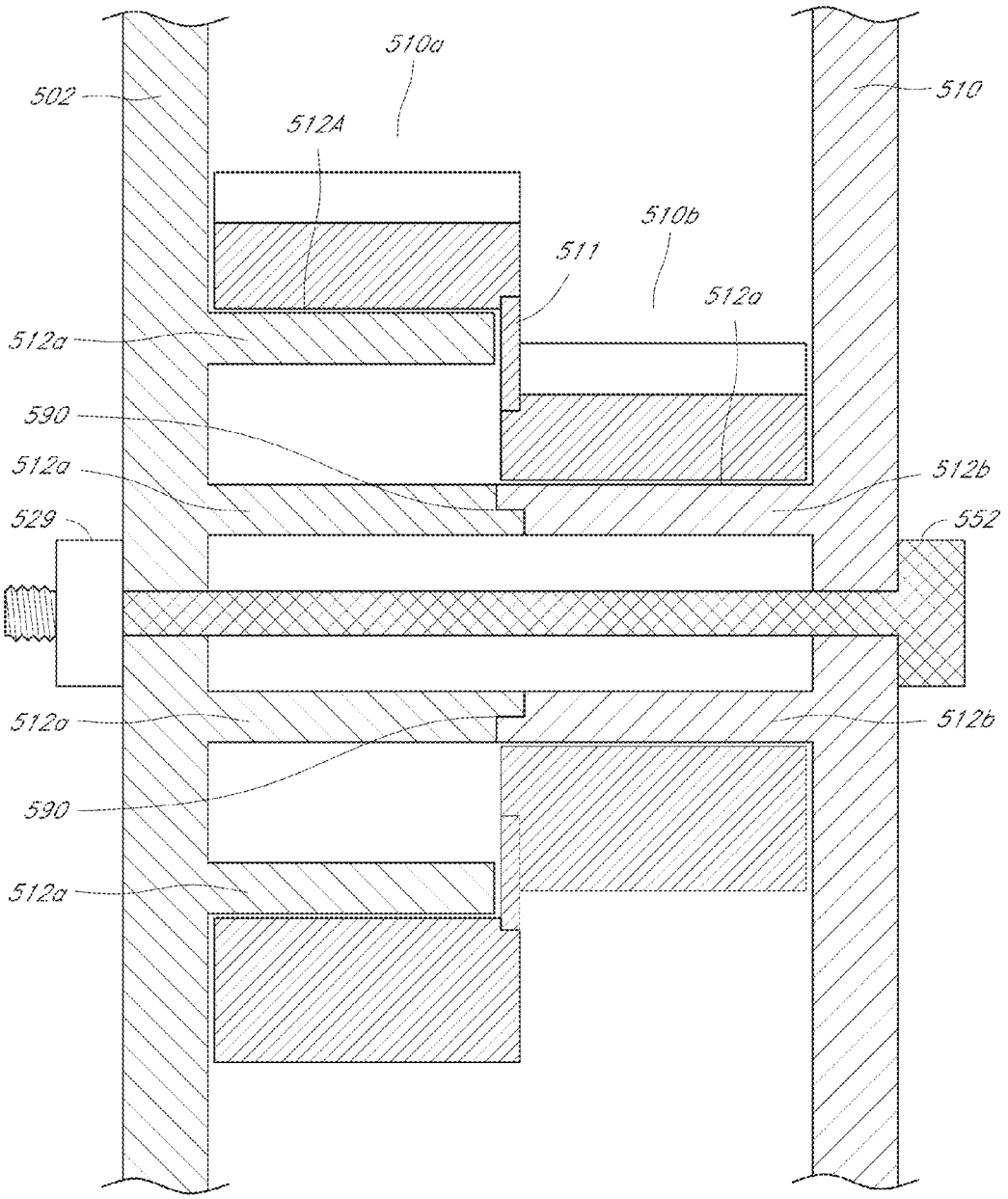
FIG. 11 is a sectional view of an embodiment of an timing idler gear compatible with each of the embodiments shown and described herein.

FIG. 11 depicts another embodiment of an idler gear 510 comprising a first split section 510*a* and a second split section 510*b* rigidly connected with each other and rotating together on an idler shaft 512. In some embodiments, an idler rim gear can define more than one idler gear, for example, by having multiple portions with different diameters each. For example, an idler rim gear can include two different diameters with gear teeth at each the two different diameters that rotate about the same idler shaft.

In other instances, one head of a multi-head engine (e.g. a V-type engine block) is offset from a second head of the engine, with two timing geartrains that are offset from each other (e.g., along the direction of the crankshaft of the engine) and correspond to the different heads. Optionally, the idler gear 510 comprises the first split section 510*a* having a first diameter and the second split section 510*b* having a second diameter. Optionally, the split section 510*a* can rotate about a first idler shaft section 512*a* having a corresponding first diameter and the split section 510*b* can rotate about a second idler shaft section 512*b* having a corresponding second diameter. Optionally, the first and second split sections can be rigidly attached by a faceplate 511. Optionally, the idler shaft 512 extends from one of the chamber members or the engine housing wall. Optionally, corresponding split sections 512*a*, 512*b* extend from opposite chamber members and/or engine housing walls.

In some other embodiments, the first idler shaft section 512*a* and the second idler shaft section 512*b* meet at an interface 590. Optionally, the interface 590 comprises two interlocking and concentric circular sections on each of the shaft sections 512*a, b*. Interface 590 can have the advantage of providing a haptic locating mechanism when aligning and mounting the chamber member or the engine housing wall with the corresponding engine housing wall or the chamber member.

In some embodiments the chamber member 510 can be coupled with the housing wall 502 through a mechanical fastener 552 extending from an exterior side of chamber member 510 through the engine housing wall 502. Optionally, the mechanical fastener 552 can be a bolt and a nut 529.

Each the embodiments of the disclosure shown in FIG. 11 and described in the preceding paragraphs can be used with each of the other embodiments described herein.

OEM Engines Using a Valvetrain and Comprising a Timing Idler Gear

Figure 12B:
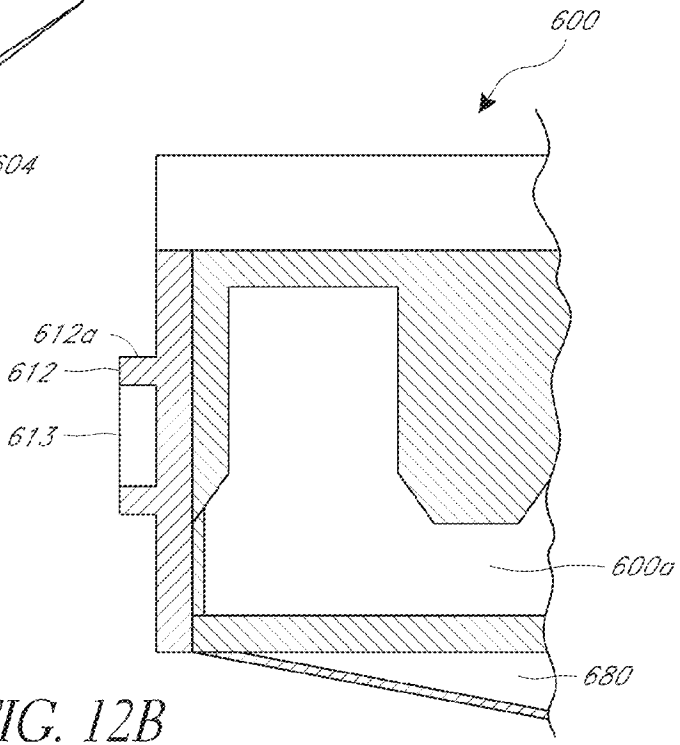
FIG. 12B is a sectional view taken along the line 12B in FIG. 12A.
Figure 12A:
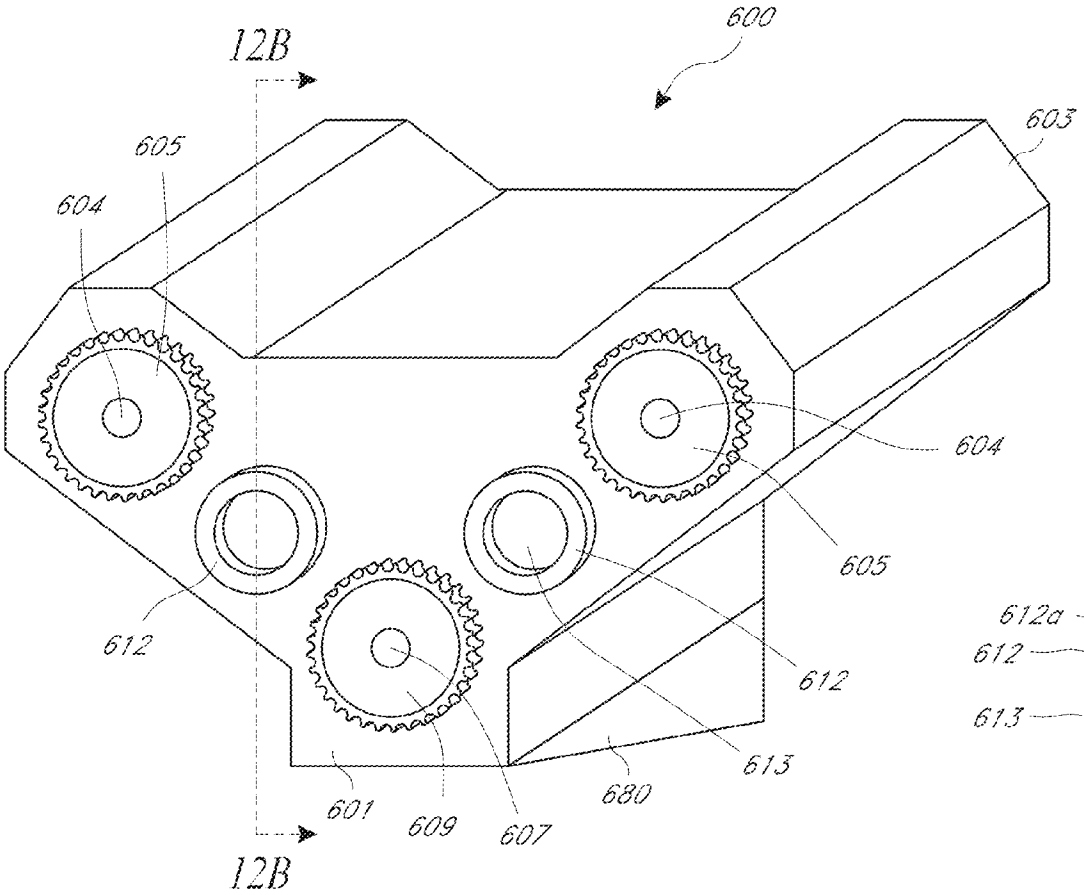
FIG. 12A is a schematic illustration an embodiment of an engine comprising timing idler gear shafts.

FIGS. 12A-15C depict an engine 600 that utilizes at least one idler shaft 612 and at least one corresponding timing idler gear 610. Accordingly, each of the features of the above embodiments may be used in combination with the features of the engine 600. FIG. 12A depicts the engine 600 comprising the idler shaft 612 extending from an engine housing 602. Optionally, the engine 600 comprises a head 603, an engine block 601 and the engine housing 602. Optionally, the engine 600 also comprises a crankshaft 607, a crank gear 609, a cam gear 605 and a camshaft 604. Optionally, the idler shaft 612 is integrally formed with the engine housing 602. In other embodiments the idler shaft 612 is mechanically fastened to the engine 600 through conventional means as described above in reference to previous embodiments.

FIG. 12B depicts a sectional view of engine 600 taken in FIG. 12A. Optionally, the engine 600 includes an interior space 613 and an exterior surface 612*a* of the idler shaft 612 configured to rotatably support the timing idler gear 610. In some embodiments of the present invention, interior space 613 is an empty volume, but in other embodiments it is a solid volume. Optionally, engine 600 can also comprise an oil reservoir 680. Optionally, the engine 600 can further comprise a plurality of mounting locations (not shown) configured to mount a chamber member 620 with the engine housing wall 602 (FIGS. 14A, B).

In some embodiments, the idler gear 610 comprises a rim gear as shown herein and described above. Optionally, the idler gear 610 can comprise a power takeoff shaft with at least one passageway through the chamber member 620 as shown and described above in relation to the other embodiments.

Figure 13B:
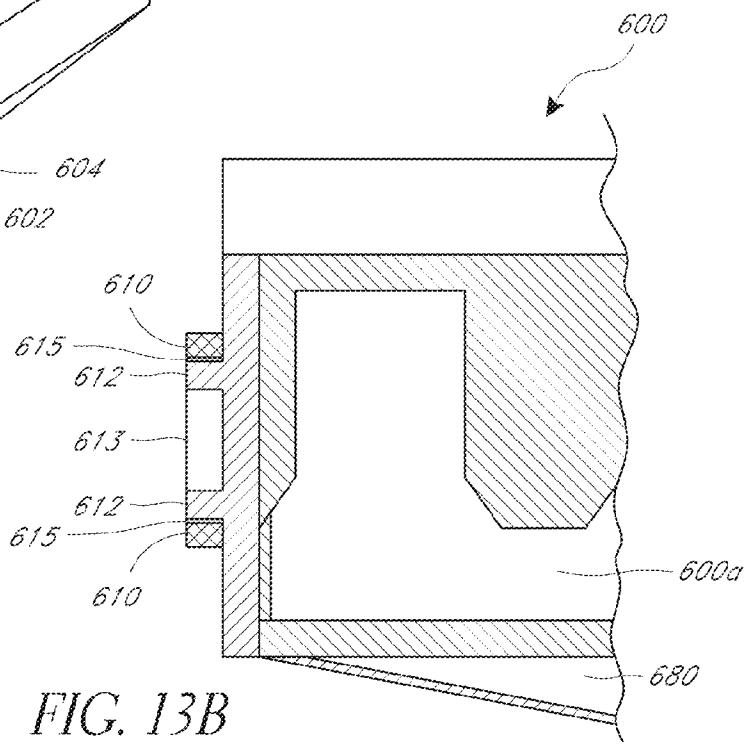
FIG. 13B is a sectional view taken along the line 13B in FIG. 13A.
Figure 13A:
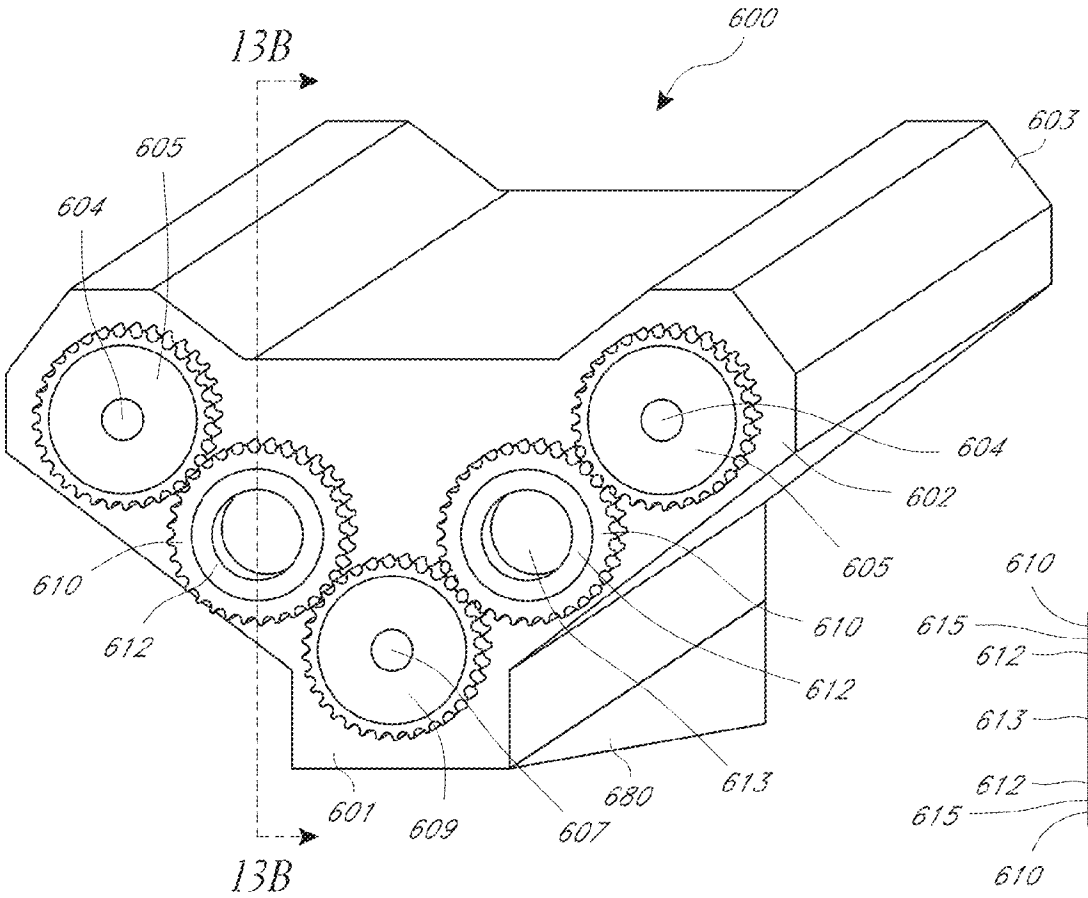
FIG. 13A is a schematic illustration of the engine in a partially assembled state.

FIGS. 13A and 13B depict an assembled view of the engine 600 comprising the timing idler gear 610 mounted on the idler shaft 612 and rotatably coupled with one of the crank gear 609 and/or the cam gear 605. Optionally, timing idler gear 610 can be mounted onto the exterior surface 612*a* of the idler shaft 612. Optionally, the timing idler gear 610 is mounted on a bearing 615, such as a needle or ball bearing, that is mounted to the exterior surface 612*a* of the idler shaft 612 to reduce friction between idler shaft 612 and idler gear 610. In other embodiments, the bearing 615 can be a plain, sleeve, or hydrodynamic bearing. Optionally, exterior surface 612*a* is honed to reduce friction between the idler gear 610 and the idler shaft 612. In the form of plain or sleeve bearings, the bearing 615 can have a polished surface corresponding to the outer surface 612*a* of the idler shaft 612, optionally lubricated with grease or oil. In some embodiments, oil for the bearing 615 is supplied continuously during operation so that the idler gear 610 rotates on a thin oil film, optionally, under the principle of operation of a hydrodynamic bearing.

Figure 14B:
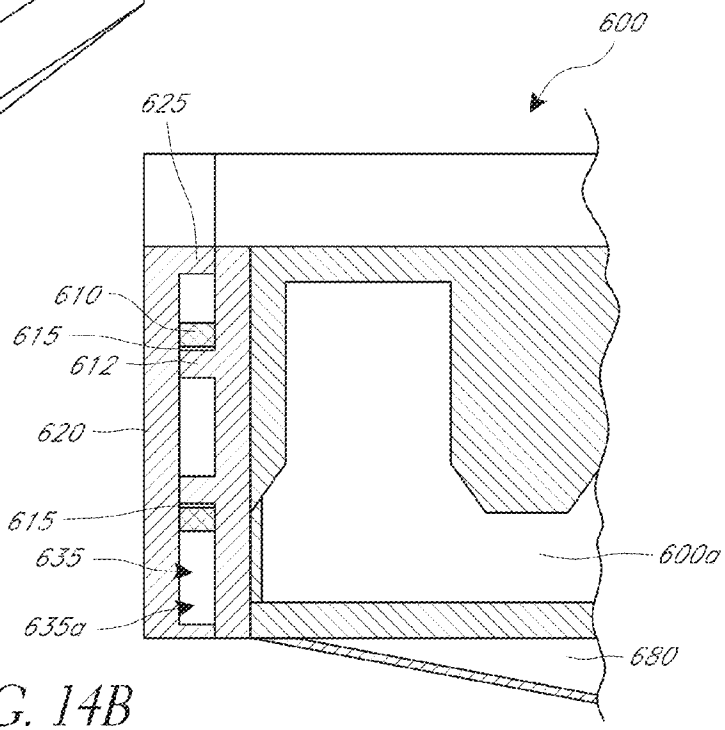
FIG. 14B is a sectional view taken along the line 14B in FIG. 14A.
Figure 14A:
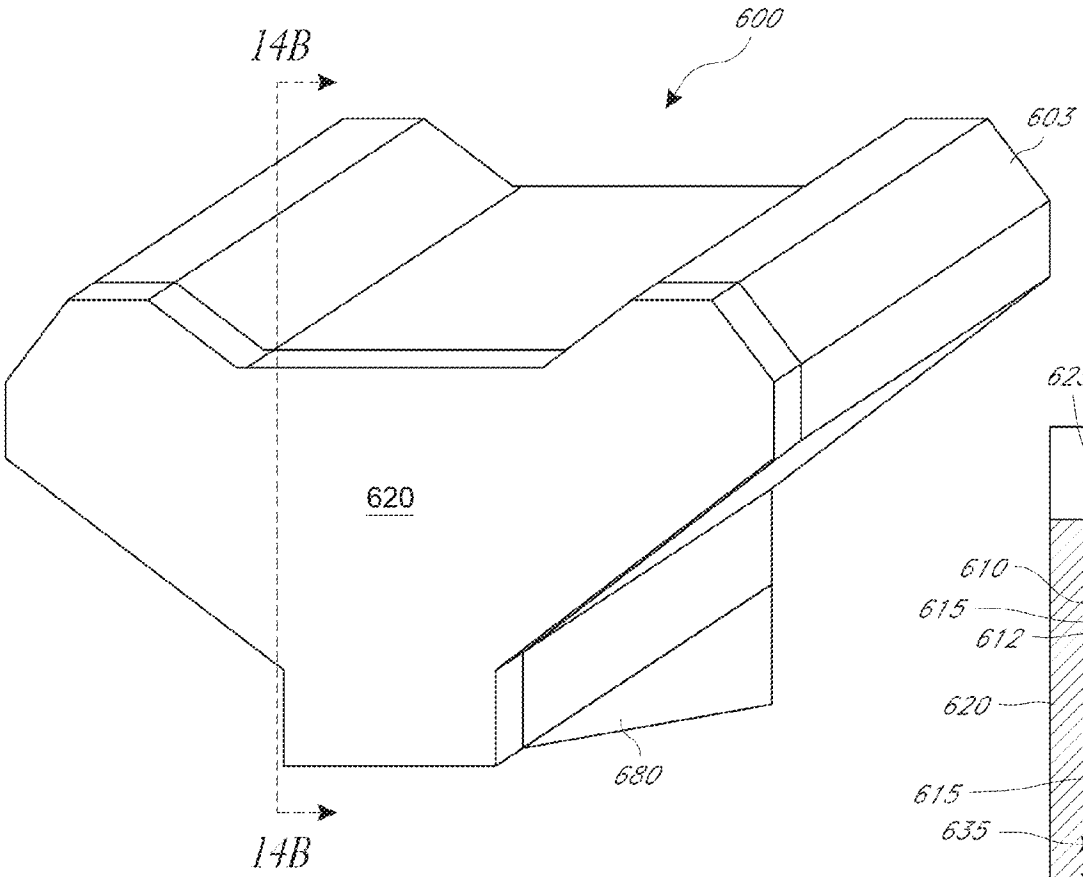
FIG. 14A is a schematic illustration of the engine in a partially assembled state.

FIGS. 14A and 14B depict a view of the engine 600 in an assembled state and including the chamber member 620. In some embodiments, the chamber member 620 functions to maintain the idler gear 610 on the idler shaft 612 so that it can rotate securely about the idler shaft 612. As described above in reference to other embodiments, both the engine housing wall 602 and the chamber member 620 can comprise honed portions to reduce friction at the locations where the timing idler gear 610 contacts the chamber member and the housing wall respectively.

In some embodiments of the engine 600, chamber member 620 can comprise a peripheral wall 625 configured to create a chamber 635 that encompasses the idler gear 610. Optionally, the wall 625 extends from the engine housing 602. In a preferred embodiment, an interface between the peripheral wall 625 and the engine housing 602 comprises a gasket configured to seal the chamber 635 to prevent oil leakage. In another preferred embodiment, the chamber member 620 comprises a top portion and a bottom portion, the top portion being removable from the engine 600 with the lower portion remaining in place such that an oil reservoir 635*a* can retain an oil supply during partial disassembly of the engine 600.

Figure 15B:
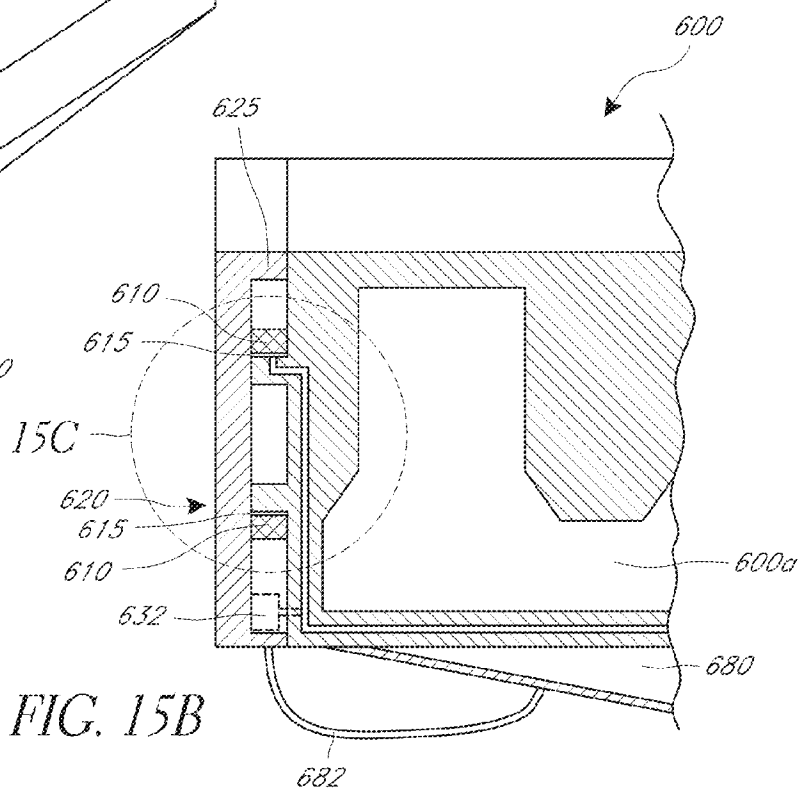
FIG. 15B is a sectional view taken along the line 15B in FIG. 15A.
Figure 15A:
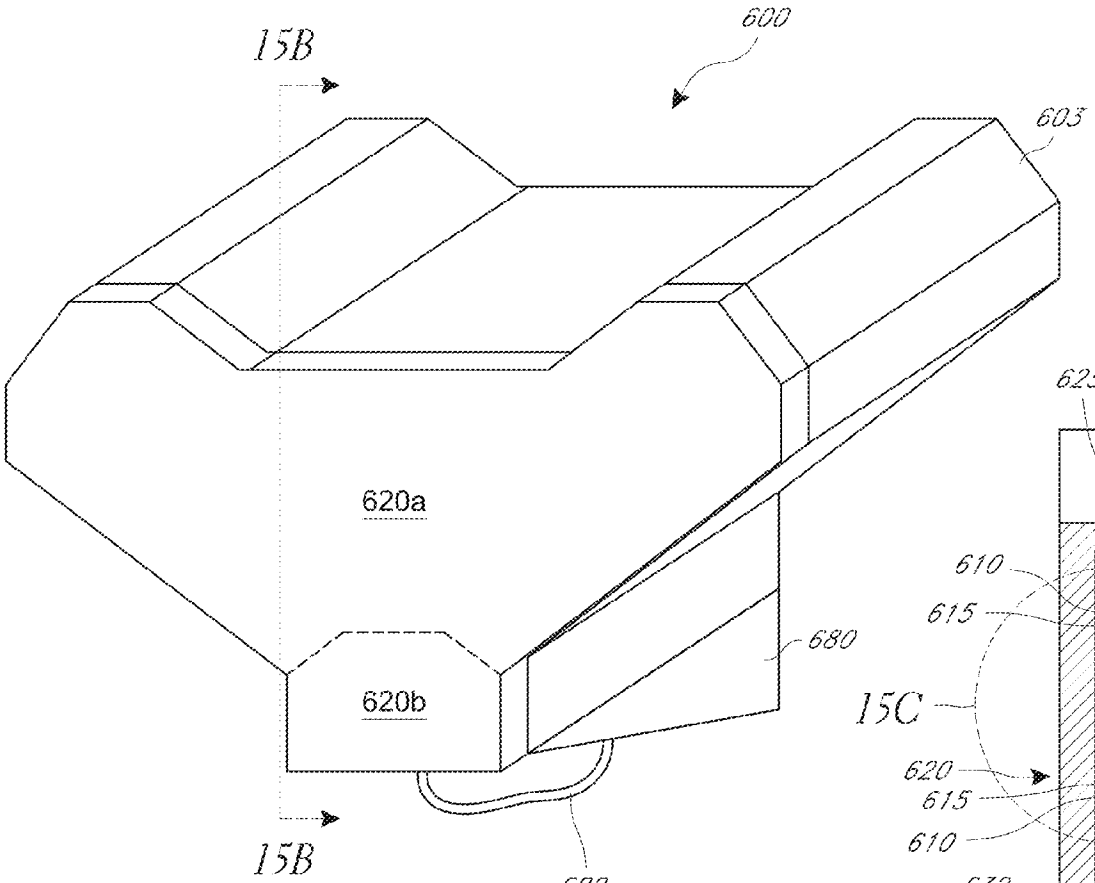
FIG. 15A is a schematic, perspective view of the engine comprising timing idler gear shafts in an assembled state.
Figure 15C:
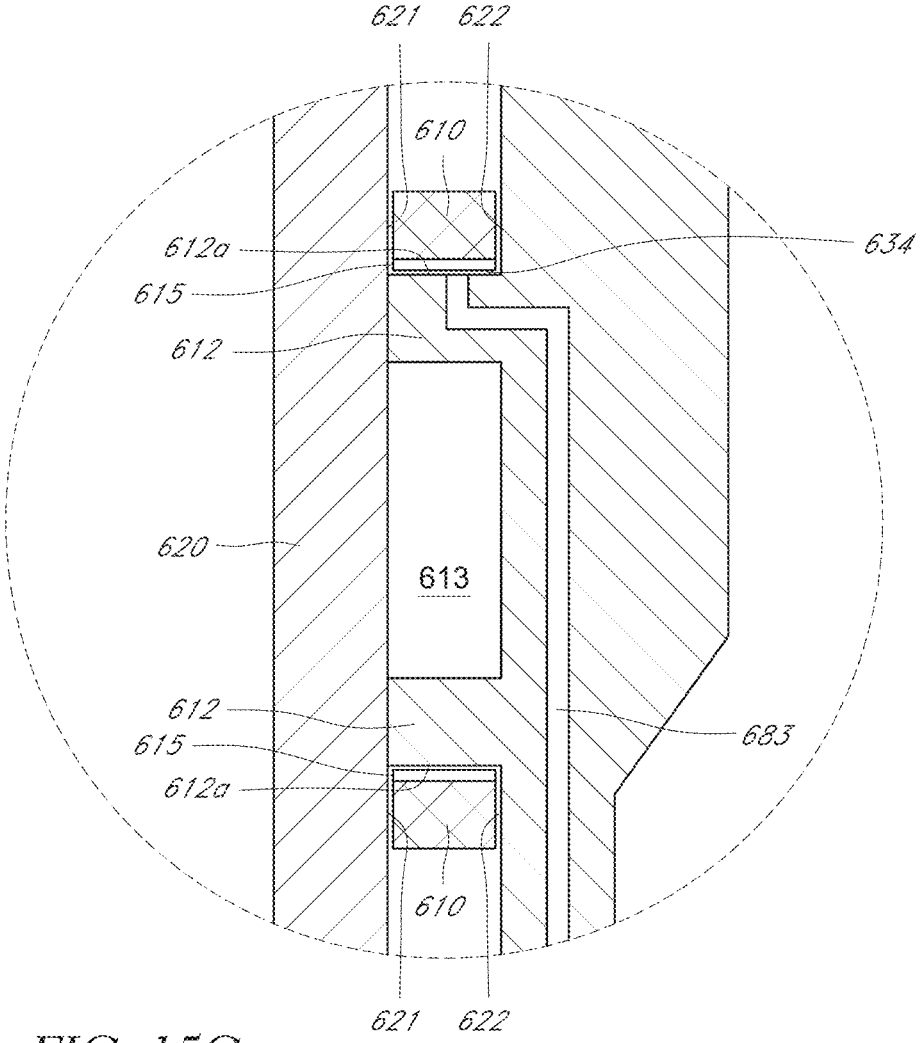
FIG. 15C is a detail view of FIG. 15B.

FIGS. 15A-15C depict a view of engine 600 comprising a lubrication assembly. In some embodiments, an oil supply line 683 is fluidly coupled between an oil reservoir 680 and a lubrication space 634 located between the exterior surface 612*a* and the idler gear 610. Optionally, the engine 600 comprises an oil pump (not shown) configured to deliver the oil supply from the reservoir 680 to the lubrication space 634. Optionally, the oil supply line 683 comprises an interior portion that passes through the engine housing wall in a fluid passageway. Optionally, the oil supply line can comprise an exterior portion that passes through an oil tube. Optionally, a return oil line 682 can be coupled with the bottom of the chamber 635 and communicatively coupled to the oil reservoir 680 through a drain 681. Optionally, the oil pump is located within the oil reservoir 680. Optionally, the oil supply line 683 can fluidly couple the chamber 635 with the lubrication space 634. Optionally, the oil pump is configured to deliver an oil supply to the lubrication space 634 from an oil reservoir 635*a* within the chamber 635. Optionally, the oil pump is located within the chamber 635. Optionally, the oil pump is located exterior to the chamber 635.

In some embodiments, the chamber member 620 comprises a top portion 620*a* and a bottom portion 620*b*. Optionally, the bottom portion 620*b* is configured to comprise the oil reservoir 680 as discussed above. Optionally, both portions 620*a, b* are configured to be assembled with the engine 600. Optionally, the bottom portion 620*b* is configured to remain assembled with the engine 600 when the top portion 620*a* is removed from the engine 600 and thereby the oil reservoir 680 can remain in place while an operator obtains access to the geartrain by removing the top portion 620*a*.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

What is claimed is:

1. A valvetrain conversion kit for an engine, comprising:

at least one timing idler rim gear configured to be meshed with at least one of a crank gear of the engine and a cam gear of the engine;

a first timing gear chamber member having an interior surface and an exterior surface, the first timing gear chamber member having a plurality of engine mounting locations corresponding to a plurality of corresponding mounting locations on an internal combustion engine body, the first timing gear chamber member configured to be rigidly attached to an engine body at the plurality of engine mounting locations;

the first timing gear chamber member further comprising a timing idler rim gear shaft supported by the interior surface, the timing idler rim gear shaft having an exterior shaft surface, the exterior shaft surface configured for rotatably supporting the timing idler rim gear; and an oil passage extending at least partially through an interior of the timing idler rim gear shaft to the exterior shaft surface and configured to guide an oil lubricant to a lubricant space between the exterior shaft surface and a rotational surface of the timing idler rim gear when the at least one timing idler rim gear is positioned about the exterior shaft surface.

2. The valvetrain conversion kit of claim 1, further comprising: a second timing gear chamber member configured to engage the first timing gear chamber member to define an enclosed timing gear chamber about the at least one timing idler gear and the timing idler rim gear shaft.

3. The valvetrain conversion kit of claim 1, further comprising:

a second timing idler rim gear;

a second timing idler gear shaft protruding from the interior cover surface of the timing gear chamber member; and wherein the second idler rim gear is configured to be supported for rotation about the second timing idler gear shaft and meshed with at least one of the cam gear and the crank gear.

4. The valvetrain conversion kit of claim 1, wherein the first timing gear chamber member comprises a monolithic material and the timing idler rim gear shaft and the first timing gear chamber member form a unitary structure.

5. The valvetrain conversion kit of claim 1, wherein the first timing gear chamber member faces towards the engine when assembled with the internal combustion engine.

6. The valvetrain conversion kit of claim 1, wherein the first timing gear chamber member faces away from the engine when assembled with the internal combustion engine.

7. An internal combustion engine comprising:

an engine body, the engine body supporting a crank shaft, an overhead valve camshaft, and a timing geartrain disposed on a first side of the engine body, the timing geartrain configured to transmit torque from the crankshaft to the overhead valve camshaft;

the timing geartrain including a crank gear coupled with the crankshaft, a cam gear coupled with the overhead valve camshaft, and an idler rim gear meshed with at least one of the crank gear and the cam gear;

an idler rim gear shaft disposed on the first side of the engine body and rotatably supporting the idler rim gear; and an oil line, the oil line passing at least partially through an interior portion of the idler rim gear shaft and configured to guide an oil lubricant to a lubricant space between an exterior shaft surface and a rotational surface of the idler rim gear.

8. The internal combustion engine of claim 7, further comprising a timing gear chamber member coupled with the engine body at a plurality of cover mounting locations to create a timing gear chamber, the timing gear chamber enclosing the idler rim gear shaft and the idler rim gear.

9. The internal combustion engine of claim 7, wherein the idler rim gear is a webless gear.

10. The internal combustion engine of claim 8, the idler rim gear comprising an outside diameter and an inside diameter, wherein the inside diameter is equal to or greater than approximately 50% of the outside diameter.

11. An internal combustion engine comprising:

an engine body, the engine body supporting a crank shaft, an overhead valve camshaft, and a timing geartrain disposed on a first side of the engine body, the timing geartrain configured to transmit torque from the crankshaft to the overhead valve camshaft;

the timing geartrain including a crank gear coupled with the crankshaft, a cam gear coupled with the overhead valve camshaft, and an idler rim gear meshed with at least one of the crank gear and the cam gear;

a timing gear chamber member coupled with the engine body at a plurality of cover mounting locations to create a timing gear chamber, the timing gear chamber enclosing the idler rim gear shaft and the idler rim gear;

an idler rim gear shaft disposed on the first side of the engine body and rotatably supporting the idler rim gear, the idler rim gear comprising a power take-off shaft configured to extend out of the timing gear chamber.

12. A valvetrain conversion kit for an engine, comprising:

at least one timing idler gear; and a first timing gear chamber member having a plurality of engine body mounting locations and a timing idler gear shaft configured for rotatably supporting the timing idler gear; and an oil passage extending at least partially through an interior of the timing idler gear shaft to an exterior shaft surface and configured to guide an oil lubricant to a lubricant space between the exterior shaft surface and the at least one timing idler gear when assembled together.

13. The valvetrain conversion kit for an engine of claim 12, wherein the at least one timing idler gear is configured to be meshed with at least one of a crank gear of the engine and a cam gear of the engine.

14. The valvetrain conversion kit for an engine of claim 12, wherein the first timing gear chamber member is configured to be rigidly attached to an engine body at the plurality of engine mounting locations.

15. The valvetrain conversion kit of claim 12, wherein the timing idler gear is a rim gear.

16. The valvetrain conversion kit of claim 15, the rim gear comprising an outside diameter and an inside diameter, wherein the inside diameter is equal to or greater than approximately 50% of the outside diameter.

17. The valvetrain conversion kit of claim 15, the rim gear comprising an outside diameter and an inside diameter, wherein the inside diameter is equal to or greater than approximately 75% of the outside diameter.

18. The valvetrain conversion kit of claim 12 wherein the timing idler gear is configured to be rotatably supported by the timing idler gear shaft without a bearing.

19. A valvetrain conversion kit for an engine, comprising:

at least one timing idler gear; and a first timing gear chamber member having a plurality of engine body mounting locations and a timing idler gear shaft configured for rotatably supporting the timing idler gear, the timing idler gear comprising a power take-off shaft.

20. The valvetrain conversion kit of claim 19, the power take-off shaft rigidly coupled with the timing idler gear through a face plate.

21. A valvetrain conversion kit for an engine, comprising:

at least one timing idler gear;

a first timing gear chamber member having a plurality of engine body mounting locations and a timing idler gear shaft configured for rotatably supporting the timing idler gear; and a second timing gear chamber member having a plurality of cover mounting locations, the second timing gear chamber member being configured to create a chamber to enclose the at least one timing idler gear, a crank gear, and a cam gear when assembled with the first timing gear chamber member;

wherein the second timing gear chamber member comprises a top portion and a bottom portion, the bottom portion configured to remain assembled with the first timing gear chamber member when the top portion is removed from the first timing gear chamber member.

22. The valvetrain conversion kit of claim 21, wherein the bottom portion of the second timing gear chamber member is configured to comprise an oil reservoir when assembled with the first timing gear chamber member.

* * * * *